United States Patent [19]

Ricketts

[11] 4,192,554

[45] Mar. 11, 1980

[54] METHOD FOR EXPLOSIVE EXPANSION TOWARD HORIZONTAL FREE FACES FOR FORMING AN IN SITU OIL SHALE RETORT

[75] Inventor: Thomas E. Ricketts, Bakersfield, Calif.

[73] Assignee: Occidental Oil Shale, Inc., Grand Junction, Colo.

[21] Appl. No.: 929,250

[22] Filed: Jul. 31, 1978

[51] Int. Cl.[2] ..... E21C 41/10

[52] U.S. Cl. ..... 299/2; 102/23

[58] Field of Search ..... 299/2, 13; 166/299; 102/23

[56] References Cited

U.S. PATENT DOCUMENTS

| | | | |
|---|---|---|---|
| 1,913,395 | 6/1933 | Karrick | 299/2 |
| 3,661,423 | 5/1972 | Garrett | 299/2 |
| 4,043,595 | 8/1977 | French | 299/2 |
| 4,043,596 | 8/1977 | Ridley | 299/2 |
| 4,043,597 | 8/1977 | French | 299/2 |
| 4,043,598 | 8/1977 | French et al. | 299/2 |

*Primary Examiner*—Ernest R. Purser

*Attorney, Agent, or Firm*—Christie, Parker & Hale

[57] ABSTRACT

Formation is excavated from within a retort site in formation containing oil shale for forming a plurality of vertically spaced apart voids extending horizontally across different levels of the retort site, leaving a separate zone of unfragmented formation between each pair of adjacent voids. Explosive is placed in each zone, and such explosive is detonated in a single round for forming an in situ retort containing a fragmented permeable mass of formation particles containing oil shale. The same amount of formation is explosively expanded upwardly and downwardly toward each void. A horizontal void excavated at a production level has a smaller horizontal cross-sectional area than a void excavated at a lower level of the retort site immediately above the production level void. Explosive in a first group of vertical blast holes is detonated for explosively expanding formation downwardly toward the lower void, and explosive in a second group of vertical blast holes is detonated in the same round for explosively expanding formation upwardly toward the lower void and downwardly toward the production level void for forming a generally T-shaped bottom of the fragmented mass.

57 Claims, 7 Drawing Figures

METHOD FOR EXPLOSIVE EXPANSION TOWARD HORIZONTAL FREE FACES FOR FORMING AN IN SITU OIL SHALE RETORT

BACKGROUND OF THE INVENTION

This invention relates to in situ recovery of shale oil, and more particularly, to techniques for explosive expansion toward horizontal free faces of formation within a retort site for forming an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen," which, upon heating, decomposes to produce liquid and gaseous products. It is the formation containing kerogen that is called "oil shale" herein, and the liquid hydrocarbon product is called "shale oil."

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits have been described in several patents, such as U.S. Pat. Nos. 3,661,423; 4,043,595; 4,043,596; 4,043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting." Such decomposition in the oil shale produces gaseous and liquid products, including gaseous and liquid hydrocarbon products, and a residual solid carbonaceous material.

The liquid products and the gaseous products are cooled by the cooled oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above another within the retort site. A plurality of vertically spaced apart zones of unfragmented formation are temporarily left between the voids. Explosive is placed in each of the unfragmented zones and detonated, preferably in a single round, to explosively expand each unfragmented zone into the voids on either side of it to form a fragmented mass having a void volume equal to the void volume of the initial voids. Retorting of the fragmented mass is then carried out to recover shale oil from the oil shale.

It is desirable to have a generally uniformly distributed void volume, or a fragmented mass of generally uniform permeability so that oxygen supplying gas can flow relatively uniformly through the fragmented mass during retorting operations. Techniques used for explosively expanding zones of unfragmented formation toward the horizontal free faces of formation adjacent the voids can control the uniformity of particle size or permeability of the fragmented mass. A fragmented mass having generally uniform permeability in horizontal planes across the fragmented mass avoids bypassing portions of the fragmented mass by retorting gas as can occur if there is gas channeling through the mass owing to non-uniform permeability.

Liquid and gaseous products of retorting can be withdrawn from the bottom of the fragmented mass through a drift excavated near a production level of the fragmented mass. In one embodiment, liquid products can be withdrawn by forming a generally funnel-shaped bottom of the fragmented mass so that liquid products flowing under gravity can be funneled downwardly to the production level drift for collection. In another embodiment, the fragmented mass can have a relatively flat bottom with a horizontal cross-sectional area similar to that in upper elevations of the fragmented mass. In this instance, a production level drift can be excavated on a production level spaced below the bottom of the fragmented mass, and narrow product withdrawal passages can be drilled between the bottom of the fragmented mass and the top of the production level drift. In either instance, the funnel-shaped bottom, or the product withdrawal passages if not designed properly can create a substantial constriction in the horizontal cross-sectional area through which gas can flow between upper regions of the fragmented mass and the production level drift. Such a constriction to gas flow can increase gas velocities in the lower portion of the fragmented mass to as high as 5 to 10 times the velocity of gas flow in the upper elevations of the fragmented mass. Such a high gas velocity can entrain shale oil droplets in the gas flowing through the lower portion of the fragmented mass, producing aerosols which are withdrawn in the retort stack gas. To maximize the product yield of the retort, it is desirable to minimize the amount of shale oil withdrawn as an aerosol in the retort stack gas.

SUMMARY OF THE INVENTION

The present invention provides a method for forming an in situ oil shale retort containing a fragmented permeable mass of formation particles containing oil shale. The fragmented mass is formed by excavating formation from within a retort site for forming at least one void extending horizontally across the retort site, leaving an upper zone of unfragmented formation within the retort site above the horizontal void, and leaving a lower zone of unfragmented formation within the retort site below the horizontal void. Explosive placed in the upper and lower zones is detonated for explosively expanding substantially the same amount of formation downwardly from the upper zone toward the void that is explosively expanded upwardly from the lower zone toward the void.

In another aspect of the invention, formation is excavated from within a lower portion of the retort site for forming a first void extending horizontally across a lower level of the retort site and a production level void extending horizontally across the retort site immediately below the first void. The first void has a substantially greater horizontal cross-sectional area than the production level void. A first zone of unfragmented formation is left between the first void and the production level void. A plurality of vertical blast holes are drilled in the zone of unfragmented formation. Explosive is placed in the blast holes and such explosive is detonated for explosively expanding the zone of formation toward the first void and the production level void for forming a lower portion of a fragmented mass in an in situ oil shale retort. Explosive in a first group of such vertical blast holes is detonated for explosively expanding formation from the lower zone upwardly toward the first void, and explosive in a second group of such blast holes is detonated in the same round for explosively expanding formation from the lower zone upwardly toward the first void and downwardly toward the production level void for forming a generally T-shaped bottom of the fragmented mass.

DRAWINGS

These and other aspects of the invention will be more fully understood by referring to the following detailed description and the accompanying drawings, in which.

DETAILED DESCRIPTION

Figure 1:
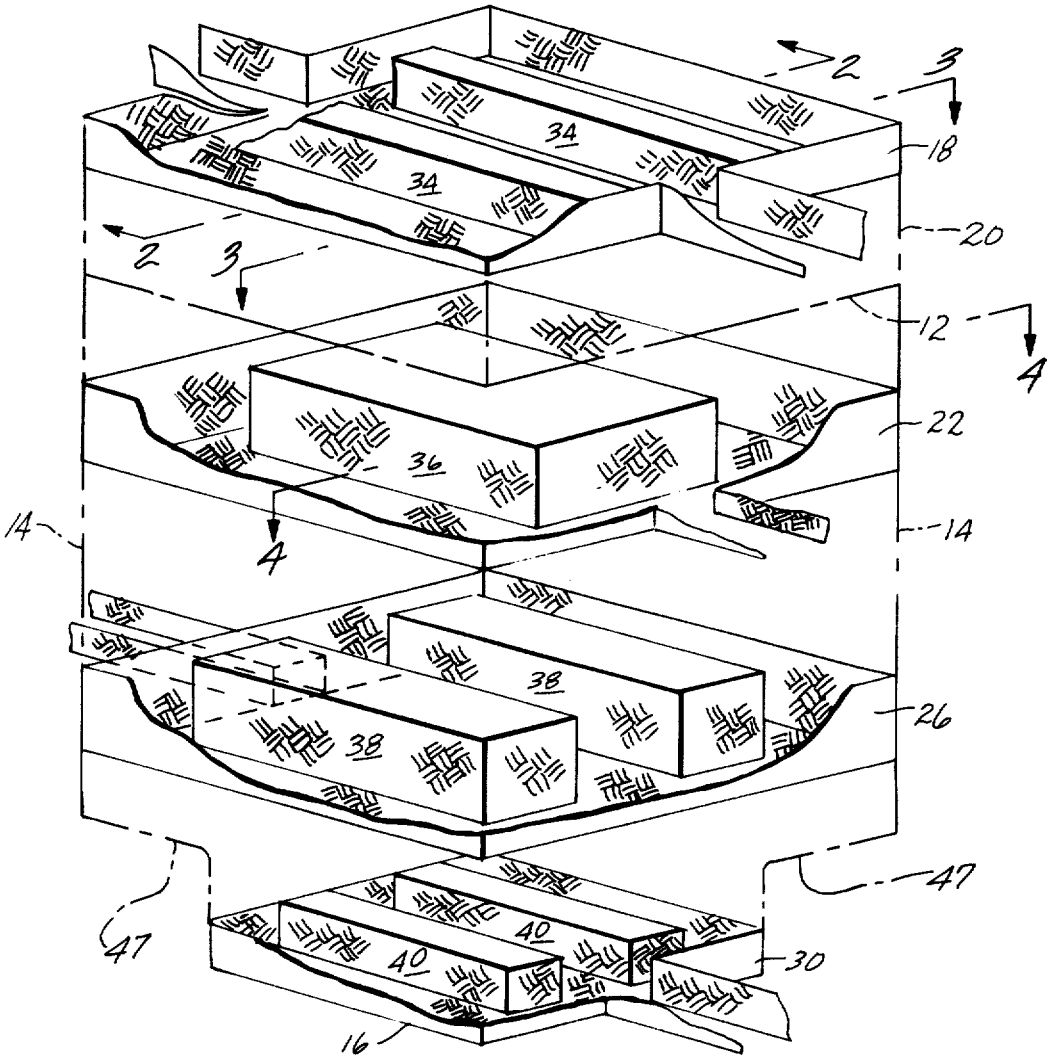
FIG. 1 is a fragmentary, semi-schematic perspective view showing a subterranean formation containing oil shale prepared for explosive expansion for forming an in situ retort according to principles of this invention.
Figure 2:
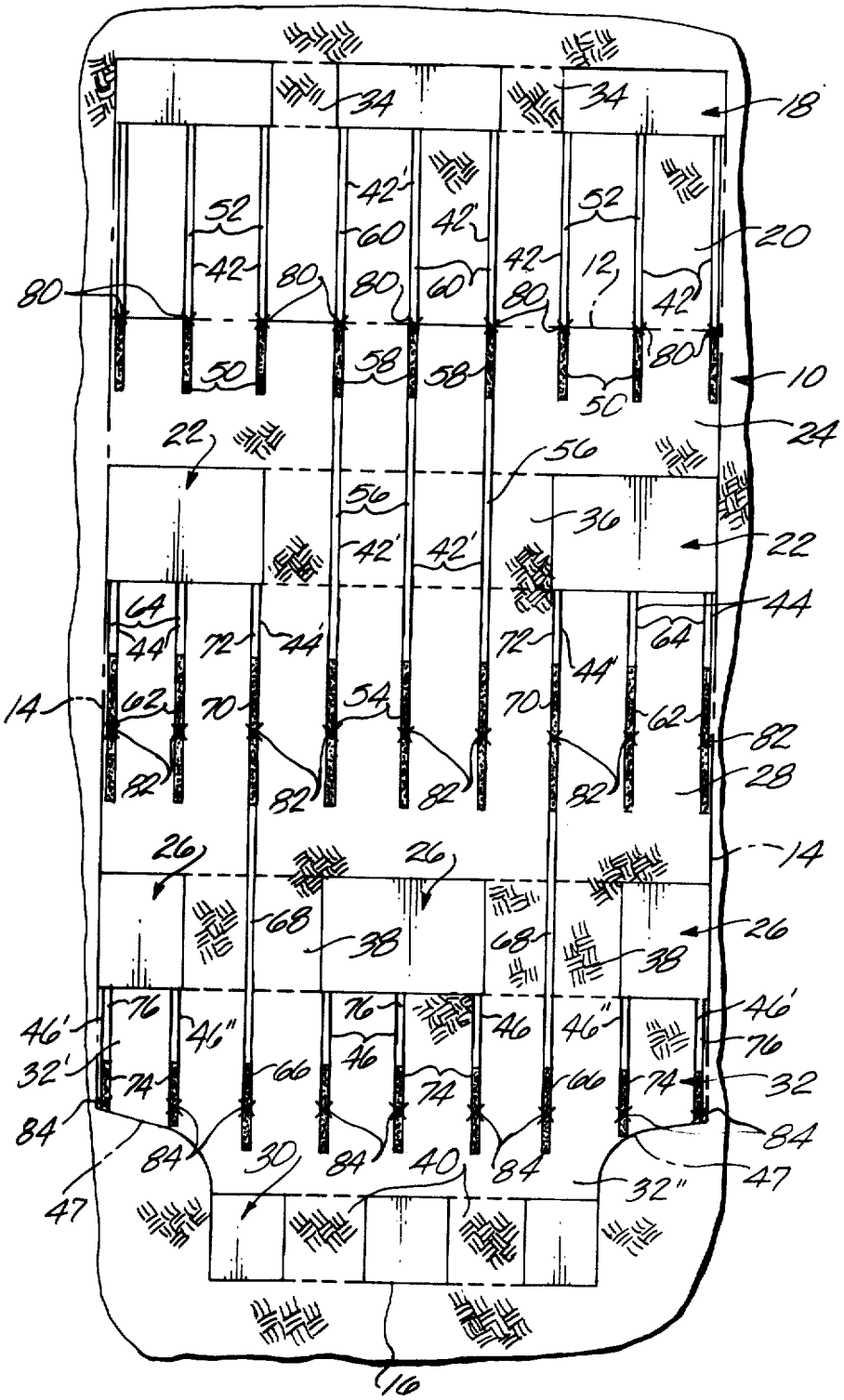
FIG. 2 is a fragmentary, semi-schematic vertical cross-sectional view taken on line 2—2 of FIG. 1.

FIGS. 1 and 2 schematically illustrate an in situ oil shale retort being formed in accordance with principles of this invention. FIG. 1 is a semi-schematic, perspective view and FIG. 2 is a semi-schematic, vertical cross-section at one stage during preparation of the in situ retort. As illustrated in FIG. 2, the in situ retort is being formed in a subterranean formation 10 containing oil shale. The in situ retort shown in FIGS. 1 and 2 is square in horizontal cross-section, having a top boundary 12, four vertically extending side boundaries 14, and a lower boundary 16.

The in situ retort is formed by a horizontal free face system in which formation is excavated from within the retort site for forming a plurality of vertically spaced apart voids each extending horizontally across a different level of the retort site, leaving zones of unfragmented formation within the retort site adjacent pairs of horizontal voids. For clarity of illustration, each horizontal void is illustrated in FIG. 1 as a rectangular box having an open top and a hollow interior. One or more pillars of unfragmented formation remain within each void for providing temporary roof support. The pillars are illustrated as rectangular boxes inside the voids illustrated in FIG. 1.

In the embodiment illustrated in FIGS. 1 and 2, a portion of the formation within the retort site is excavated on an upper working level for forming an open base of operation 18. The floor of the base of operation is spaced above the upper boundary 12 of the retort being formed, leaving a horizontal sill pillar 20 of unfragmented formation between the floor of the base of operation and the upper boundary of the retort being formed. The horizontal cross-sectional area of the base of operation is sufficient to provide effective access to substantially the entire horizontal cross-section of the retort being formed. The base of operation provides access for drilling and explosive loading for subsequently explosively expanding formation toward the voids formed within the retort site for forming a fragmented permeable mass of formation particles containing oil shale within the upper, side and lower boundaries 12, 14, 16 of the retort being formed. The base of operation 18 also facilitates introduction of oxygen supplying gas into the top of the fragmented mass being formed below the sill pillar 20, and for this reason the base of operation is referred to below as an air level void.

In the horizontal free face system illustrated in FIGS. 1 and 2, three vertically spaced apart horizontal voids are excavated within the retort site below the sill pillar 20. A rectangular upper void 22 is excavated at a level spaced vertically below the sill pillar, leaving an upper zone 24 of unfragmented formation extending horizontally across the retort site between the upper boundary 12 of the retort being formed and a horizontal upper free face above the upper void. A rectangular intermediate void 26 is excavated at an intermediate level of the retort being formed, leaving an intermediate zone 28 of unfragmented formation extending horizontally across the retort site between a horizontal lower free face below the upper void and a horizontal upper free face above the intermediate void. In the embodiment shown, the horizontal cross-sectional area within the side boundaries of the intermediate void is similar to that of the upper void and the intermediate void is directly below the upper void.

A production level void 30 is excavated at a lower production level of the retort being formed, leaving a lower zone 32 of unfragmented formation extending horizontally across the retort site between a horizontal lower free face below the intermediate void and a horizontal upper free face above the production level void. The horizontal cross-sectional area of the upper and intermediate voids is substantially greater than the horizontal cross-sectional area of the production level void. The lower zone of unfragmented formation includes a relatively wider upper portion 32' of substantially uniform height adjacent the floor of the intermediate void. The wider upper portion 32' of the lower zone has a horizontal cross-sectional area similar to that of the intermediate void. The lower zone also includes a relatively narrower lower portion 32'' having upwardly and outwardly tapering side boundaries 47 extending between the upper free face at the production level void and the wider upper portion 32' of the lower zone. Stated another way, the lower zone of unfragmented formation has opposite outer portions offset horizontally from the side boundaries of the production level void and extending vertically between the free face at the floor of the intermediate void and the tapering lower boundary 47 of the retort being formed. An inner portion of the lower zone extends between the free face at the floor of the intermediate void and the free face at the roof of the production level void.

Figure 7:
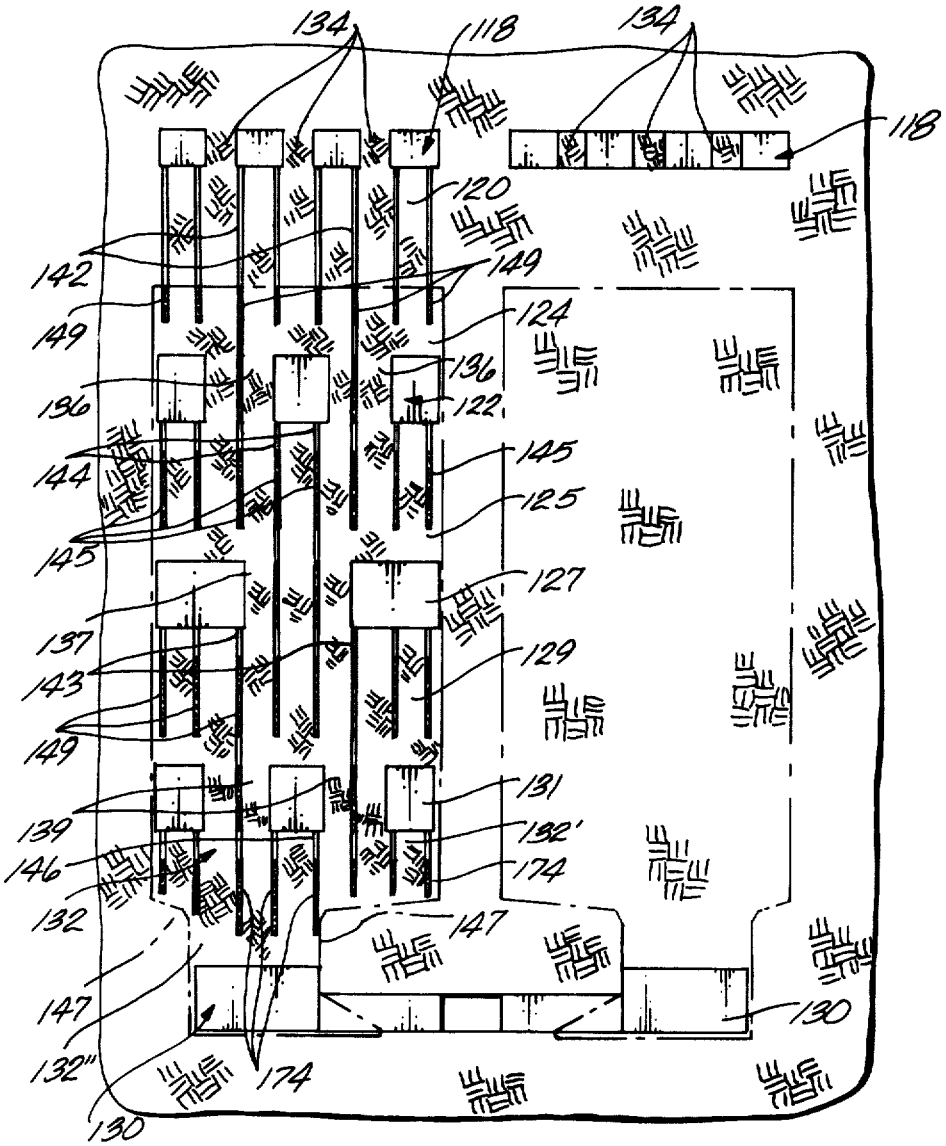
FIG. 7 is a fragmentary, semi-schematic vertical cross-sectional view showing an alternative method for preparing formation containing oil shale for explosive expansion for forming an in situ retort according to to principles of this invention.

The upper, intermediate and lower voids can occupy between about 15% to about 25% of the total volume of formation within the retort being formed. Multiple intermediate voids can be used where the height of the retort being formed is proportionately greater with respect to its width than the retort illustrated in FIGS. 1 and 2. More than one intermediate void can be used, for example, as shown in FIG. 7, so that the in situ retort can have a substantial height without need for explosively expanding excessively thick zones of unfragmented formation between adjacent horizontal voids. The embodiment illustrated in FIGS. 1 and 2 also shows one void at the lower production level, although a plurality of horizontally spaced apart horizontal voids can be used at the elevation of the production level, if desired. Such an embodiment can be useful when the horizontal cross-section of the retort is an elongated rectangle instead of a square. In the embodiment illustrated in the drawings, each of the horizontal voids is rectangular in horizontal cross-section, with the horizontal cross-sectional area of each void being similar to that of the retort being formed. The side walls of formation adjacent the air level void, the upper void and the intermediate void lie in common vertical planes, and the side walls of formation adjacent the smaller production level void are each spaced inwardly from and extend substantially parallel to corresponding side walls of formation adjacent the air level void, the upper void and the intermediate void. Although the production level void is smaller in area than the remaining voids at the retort site (i.e., the air level void, the upper void, and the intermediate void), all four side walls of the production level void need not be spaced horizontally inwardly from corresponding side walls of the remaining voids.

In a working embodiment, the vertical distance between the upper boundary 12 and the lower boundary 16 of the fragmented mass being formed is about 270 feet. The height of the upper void and of the intermediate void is about 36 feet, and the height of the production level void is about 25 feet. The height of the upper zone of unfragmented formation is about 35 feet, the thickness of the intermediate zone of unfragmented formation is about 70 feet and the height of the lower zone of unfragmented formation is about 60 feet. The upper and intermediate voids are about 160 feet wide and 160 feet long, and the lower production level void is about 100 feet wide and 100 feet long. The height of the sill pillar is about 50 feet, and the height of the air level void is about 15 feet.

Figure 3:
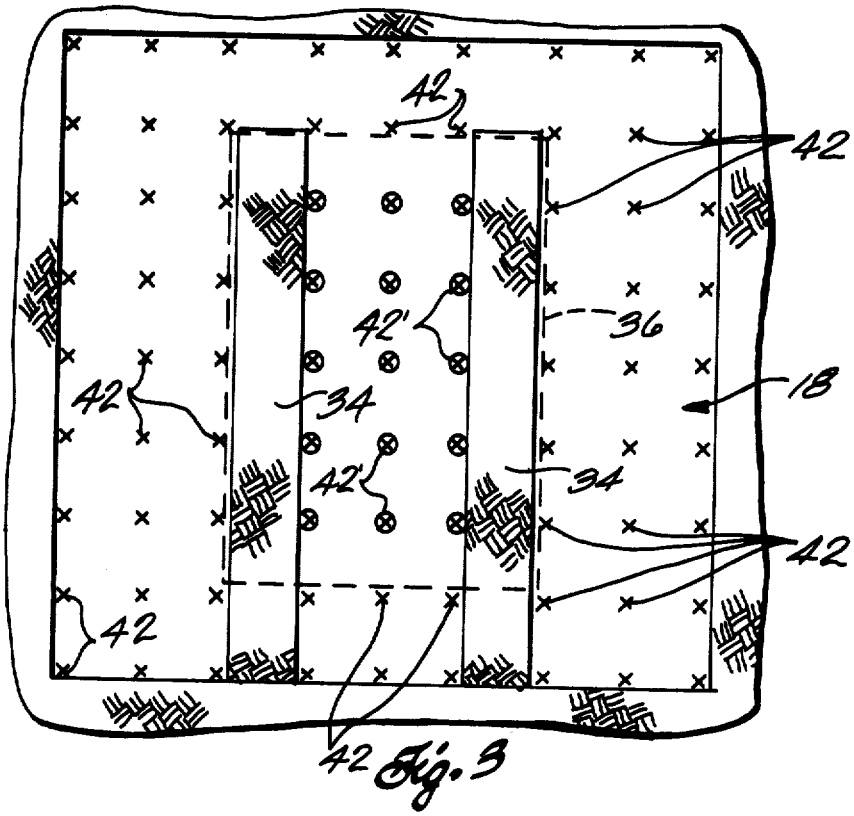
FIG. 3 is a fragmentary, semi-schematic horizontal cross-sectional view taken on line 3—3 of FIG. 1.

One or more pillars are left within each of the horizontal voids for providing temporary roof support for the zone of unfragmented formation overlying each void. Each support pillar comprises a column of unfragmented formation integral with and extending between the roof and the floor of each horizontal void. Formation can be excavated to provide pillars similar to islands in which all side walls of the pillars are spaced horizontally from corresponding side walls of formation adjacent the void; or formation can be excavated to provide pillars similar to peninsulas in which one end of the pillar is integral with a side wall of formation adjacent the void, while the remaining side walls of the pillars are spaced horizontally from the corresponding side walls of formation adjacent the void. As illustrated in FIG. 3, the air level void includes a pair of laterally spaced apart, parallel, relatively long and narrow support pillars 34 extending most of the length of the air level void. Each pillar 34 is similar to a peninsula, with one end of such a pillar being integral with a side wall of formation adjacent the air level void, forming a generally E-shaped void space within the air level void. In the illustrated embodiment, each support pillar 34 is about 16 feet wide and about 140 feet long, and the support pillars are spaced apart by a distance of about 44 feet.

Figure 4:
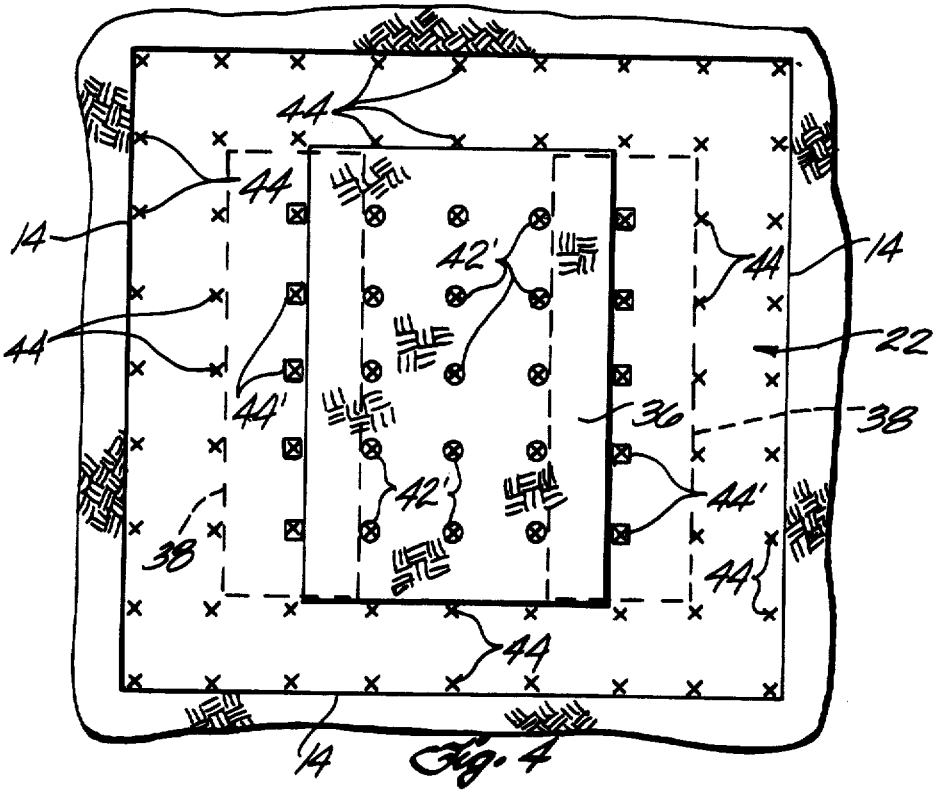
FIG. 4 is a fragmentary, semi-schematic horizontal cross-sectional view taken on line 4—4 of FIG. 1.

As illustrated in FIG. 4, the upper void 22 includes one large support pillar 36 of rectangular horizontal cross-section located centrally within the upper void. The pillar 36 is similar to an island, with all side walls of the pillar being spaced from corresponding side walls of formation adjacent the upper void, forming a generally rectangular peripheral void space surrounding all four side walls of the support pillar. In the working embodiment, the support pillar in the upper void is about 70 feet wide and about 116 feet long.

The intermediate void 26 includes a pair of laterally spaced apart, parallel, relatively long and narrow support pillars 38. As illustrated in broken lines in FIG. 4, the support pillars in the intermediate void extend a major part of the width of the void. These pillars are similar to islands in that a void space surrounds the entire periphery of each pillar. In the working embodiment illustrated in the drawings, the support pillars 38 in the intermediate void are about 36 feet wide and about 112 feet long, and adjacent inside walls of the pillars are spaced apart by a distance of about 45 feet. About 24 feet of void space is provided between the ends of each pillar and the adjacent end walls of the formation at the edges of the intermediate void. About 24 feet of void space is left between the outside wall of each pillar and the adjacent side wall of formation at the edge of the void. The excavated volume of the upper void is about the same as the excavated volume of the intermediate void so that formation expanded toward such voids has the same void volume into which to expand. This promotes uniformity of void fraction distribution.

The production level void 30 includes a pair of laterally spaced apart, relatively long and narrow, parallel support pillars 40 extending a major part of the width of the production level void. The support pillars 40 are similar to peninsulas, forming a generally E-shaped void space within the lower void. The ends of the pillars in the lower void are integral with the rear wall of the lower void, as the retort is viewed in FIG. 1. In the working embodiment illustrated in the drawings, the support pillars in the lower void are about 70 feet long and about 20 feet wide. The inside walls of the pillars are spaced apart by about 20 feet, and the outside wall of each pillar is spaced about 20 feet from the adjacent side wall of formation at the edge of the lower void.

Thus, a first or upper horizontal void within the boundaries of the retort being formed provides an open floor space vertically above at least a portion of a pillar in a second or lower horizontal void immediately below the first horizontal void. The lower void is considered to be spaced immediately below the upper void in that there is no horizontal void intervening between the upper void and the lower void. The open floor space provided by the upper void directly above a portion of the pillar in the lower void provides an access region for drilling at least one vertical blast hole from the upper void through the pillar into the zone of unfragmented formation below the pillar in the lower void. Such an open floor apace can be formed by leaving a first pillar in the upper void such that the first pillar is offset horizontally relative to at least a portion of a second pillar in the lower void. A side wall of the first pillar can be offset horizontally from a side wall of the second pillar, or the first pillar can be narrower in width than the second pillar for providing an open floor space in the upper void spaced vertically above at least a portion of the second pillar. The open floor space is of sufficient width to facilitate drilling one or more vertical blast holes down from the open floor space in the upper horizontal void, through unfragmented formation below the upper void, through the second pillar, and into the zone of unfragmented formation below the second pillar.

With reference to the working embodiment illustrated best in FIG. 2, each pillar within the upper void 22 and the intermediate void 26 is accessible vertically from a horizontal void located immediately above such a void. Thus, those portions of the zones of unfragmented formation within the retort site which are occluded from above by the support pillars are accessible by vertical blast holes drilled through a pillar from an overlying excavation directly above the void in which the pillar is located. As a result, any blast holes which pass through these pillars do not pass vertically through more than one pillar. This arrangement can minimize the length of vertical blast holes drilled in formation below the pillars which, in turn, can aid in accurately positioning explosive charges throughout the retort site. Long blast holes have several shortcomings. They can deviate from their desired position due to inaccuracy in the angle of drilling. Explosive in such holes can be desensitized by the pressure of material in the blast hole. If plural charges are used in such holes complexity of loading is introduced by need for plural detonators.

In the working embodiment illustrated in FIG. 2, the pillars 34 in the air level void 18 extend vertically above only the outer portions of the pillar 36 in the upper void 22. A central portion of the pillar 36 in the upper void 22 is located vertically below the open floor space extending between the pillars 34 in the air level void. As best illustrated in FIG. 3, the open floor space between the pillars 34 in the air level void extends for the entire length of the pillar in the upper void. Thus, at least a portion of the pillar 36 in the upper void, as well as the zone of unfragmented formation below the pillar in the upper void can be reached by one or more vertical blast holes 42' drilled down from the floor of the air level void, through the sill pillar 20, through the upper zone 24 of unfragmented formation, through the pillar in the upper void, and into the intermediate zone 28 of unfragmented formation below the pillar in the upper void.

The pillars 38 in the intermediate void are offset horizontally relative to the pillar 36 in the upper void 22. The inside portions of the two pillars in the intermediate void are located directly below the outer portions of the pillar in the upper void, that is, there is some overlap of the upper and lower pillars. The outer portions of the pillars in the intermediate void are located vertically below an open floor space adjacent opposite side walls of the pillar in the upper void. As best illustrated in FIG. 4, at least a portion of the entire length of each pillar 38 in the intermediate void is accessible from an open floor space in the upper void. Thus, the zone of unfragmented formation below each pillar in the intermediate void can be reached by one or more vertical blast holes 44' drilled down from the floor of the upper void, through the intermediate zone 28 of unfragmented formation, through a pillar 38 in the intermediate void, and into the lower zone 32 of unfragmented formation below such a pillar.

The support pillars 40 in the production level void 30 are shown in FIG. 2 as being offset horizontally relative to corresponding pillars 38 in the intermediate void. According to principles of this invention, the pillars in the production level void need not be offset horizontally from the pillars in the intermediate void, inasmuch as access is not required for drilling blast holes into zones of unfragmented formation below the pillars in the production level void. The production level pillars can be offset if desired to permit vertical blast hole drilling into such pillars so that the pillars can be fragmented by explosive in such vertical blast holes.

Although the entire width of a support pillar in any of the horizontal voids can extend below an open floor space in a horizontal void immediately above such a pillar, it can be desirable for the upper, intermediate and production level voids to include at least one pillar positioned vertically below at least a portion of a pillar in an overlying horizontal void. This provides a continuity of structural support from top to bottom throughout the retort site for supporting the overburden overlying the retort site. This can be employed when the zone of unfragmented formation between adjacent voids is relatively thin. In the working embodiment herein described there is sufficient redistribution of stress by the 70 foot thickness of the intermediate zone 28 that no horizontal overlap of pillars in the upper and intermediate voids is needed.

Vertical blast holes can be drilled downwardly in all portions of the unfragmented formation within the boundaries of the retort site from an overlying excavation adjacent such unfragmented formation, except for regions of unfragmented formation within the retort site which are occluded from above by the support pillars. In these regions the horizontally offset support pillars can facilitate drilling of vertical blast holes into formation below the pillars from an access region in an overlying void by drilling downwardly through such a pillar. Such blast holes are drilled without passing through more than one pillar.

Referring to the working embodiment illustrated in FIG. 2, a plurality of mutually spaced apart vertical upper blast holes 42 are drilled down from the air level void through the sill pillar 20 and into at least an upper portion of the upper zone 24 of unfragmented formation above the upper void 22. The upper blast holes 42 are substantially equidistantly spaced apart in each of a plurality of rows extending across the width of the air level void. The rows of upper blast holes are parallel to one another and the rows are substantially equidistantly spaced apart from one another from the front to the rear of the air level void, the spacing between rows being the same as the spacing between blast holes in each row. The upper blast holes within each row are aligned with corresponding upper blast holes in adjacent rows to form a symmetrical pattern comprising a square matrix of array of blast holes across the floor of the air level void. A square array of blast holes is more efficient than a rectangular array for optimum interaction of explosive charges during blasting and minimum usage of explosives.

In the working embodiment, the drilling pattern for the upper blast holes is illustrated by x's shown at 42 in FIG. 3. There are nine upper blast holes in each row, and the blast holes are mutually spaced apart on 20-foot centers. A portion of the upper blast holes in the three centrally located rows are drilled down from an access region of the air level void directly above the support pillar 36 in the upper void, and these fifteen upper blast holes (identified by reference numeral 42' and a circle surrounding an x in FIGS. 3 and 4) are longer than the remaining shorter upper blast holes 42 which are drilled down from the air level void into unfragmented formation above the portion of the upper void not occupied by the support pillar 36. In the working embodiment, the fifteen longer upper blast holes 42' are drilled down from the floor space between the two support pillars 34 within the air level void. These longer upper blast holes are drilled through the sill pillar, through the upper zone of unfragmented formation, through the pillar 36 in the upper void, and through about three-fourths of the depth of the intermediate zone 28 of unfragmented formation. Each of the longer upper blast holes is about 170 to 175 feet long, and there are a total of fifteen of such blast holes, five in each row. For the embodiment shown, the remaining 66 shorter upper blast holes 42 are about 65 to 70 feet long and are drilled down from the air level void through the entire depth of the sill pillar and through about the upper half of the upper zone 24 of unfragmented formation.

In the same working embodiment, a plurality of mutually spaced apart vertical intermediate blast holes 44 are drilled down from the floor of the upper void 22 into at least a portion of the intermediate zone 28 of unfragmented formation below the upper void 22. The intermediate blast holes are drilled in a symmetrical pattern in which they are substantially equidistantly spaced apart across the width of the upper void in parallel rows which are equidistantly spaced apart from one another by the same distance to form a square matrix of blast holes similar to the upper blast holes in the air level void. There are nine intermediate blast holes drilled in each row, except for the area occupied by the pillar 36 in the upper void, and the blast holes are mutually spaced apart on 20-foot centers. Each intermediate blast hole is drilled vertically below a corresponding upper blast hole. The desired pattern of drilling the intermediate blast holes is illustrated by x's shown at 44 in FIG. 4. A portion of the intermediate blast holes are drilled through the support pillars 38 in the intermediate void, and these ten intermediate blast holes (identified by reference numeral 44' and by a square surrounding each x in FIG. 4) are longer than the remaining shorter intermediate blast holes 44. Each of the ten longer intermediate blast holes is drilled down from a floor space in the upper void immediately adjacent a corresponding outside wall of the support pillar 36 in the upper void. These ten longer intermediate blast holes are drilled down from the upper void, through the entire depth of the intermediate zone 28 of unfragmented formation, approximately through the center of the support pillars 38 in the intermediate void, and through about three-fourths the depth of the lower zone 32 of unfragmented formation below the intermediate void. In the working embodiment, the ten longer intermediate blast holes 44' are about 155 to 160 feet long and there are five of such blast holes in each row. In the same working embodiment, the remaining 56 shorter intermediate blast holes extend through about three-fourths the depth of the intermediate zone 28 of unfragmented formation and are about 50 to 55 feet long.

In the working embodiment, a plurality of mutually spaced apart vertical lower blast holes 46 are drilled down from the floor of the intermediate void into a portion of the lower zone 32 of unfragmented formation below the intermediate void. The lower blast holes are drilled on a symmetrical pattern in which they are substantially equidistantly spaced apart across the width of the intermediate void in parallel rows which are also equidistantly spaced apart by the same distance, forming a square matrix or array of blast holes similar to the square patterns of the upper and intermediate blast holes. There are nine lower blast holes in each row, except for the area occupied by the pillars 38 in the intermediate void, and the blast holes are mutually spaced apart on 20-foot centers. Each lower blast hole is drilled vertically below a corresponding upper blast hole and a corresponding intermediate blast hole.

A first group of the lower blast holes nearer the perimeter of the retort extend to the bottom boundary 47 of the fragmented mass being formed in a region of the lower zone horizontally offset from the production level void. A second group of the lower blast holes nearer the center of the retort extend into the region of the lower zone above the production level void.

Included in the first group of lower blast holes are an outer or perimeter band of 32 blast holes surrounding the intermediate void. These blast holes are drilled shorter in length than the remaining lower blast holes. Also included in the first group of the lower blast holes are a second band of 24 blast holes immediately inside the outer band. The blast holes in the second band are drilled longer in length than the blast holes in the outer band, but shorter in length than the remaining longer lower blast holes.

The second group of lower blast holes comprise the longer lower blast holes which are drilled in the central region of the lower zone of the unfragmented formation. In the working embodiment, portions of three rows of longer lower blast holes 46 are drilled down from an open floor space in the intermediate void between the pillars 38 in the intermediate void, and there are five such blast holes in each row. These fifteen longer lower blast holes extend through about three-fourths the depth of the lower zone of unfragmented formation, and each of these blast holes is about 47.5 feet long. The lower portion of each longer intermediate blast hole 44' is drilled through a pillar 38 and into the lower zone of unfragmented formation from an access region of the floor of the upper void. These portions of the intermediate blast holes extend in rows on opposite sides of the rows of longer lower blast holes 46 drilled from the intermediate void. The lower portions of the intermediate blast holes 44' are drilled to about the same depth in the lower zone as the longer lower blast holes, i.e., to about 47.5 feet below the elevation of the floor of the intermediate void. The short lower blast holes 46' in the outer band are drilled down in the lower zone of unfragmented formation adjacent each side boundary 14 of the retort being formed. The short lower blast holes terminate near the bottom boundary 47 of the fragmented mass being formed which tapers slightly downwardly and inwardly to provide a slightly sloping step. The short lower blast holes 46' surround the second band of slightly longer lower blast holes 46''. The blast holes in the second band define the location of the bottom boundary 47 of the fragmented mass being formed. There are 32 short lower blast holes 46' in the outer band adjacent a corresponding side boundary 14 of the retort. There are 24 lower blast holes 46'' in the second band immediately inside the outer band of short lower blast holes. As set forth in greater detail below, the upper portion 32' of the lower zone of formation below the intermediate void is explosively expanded upwardly toward that void. The lower portion 32'' of formation above the production level void 30 is expanded toward that void. In a working embodiment the distance between the floor of the intermediate void 26 and the roof of the lower void 30 is about 60 feet. The upper 35 feet of this zone is expanded upwardly toward the intermediate void and the lower 25 feet of the central part of the lower zone is expanded downwardly toward the production level void. The blast holes 46' in the outermost band extend to the bottom of the portion 32' expanded upwardly. The holes 46 and 44' in the region overlying the production level void extend downwardly half way through the lower portion 32'. Thus, the bottoms of these holes are about 15 feet above the roof of the production level void. The holes 46'' in the second band extend through the upper portion 32' expanded toward the intermediate void and about ¼ of the thickness of the lower portion 32'' expanded downwardly toward the production level void. In the working embodiment, each lower blast hole in the second band is about 42.5 feet long, and each lower blast hole in the outer band is about 35 feet long. Thus, the bottom boundary in the region surrounding the lower production level has a slope with a fall of about one foot per three feet of horizontal distance.

Thus, a pair of vertically adjacent horizontal voids are excavated within the retort site so that a first pillar in a first horizontal void is offset horizontally relative to a second pillar in a second horizontal void located directly below the first horizontal void. Any portion of the first pillar which extends over or overlaps the second pillar has a width not greater than the average spacing between blast holes extending from the first void into unfragmented formation between the first void and the second void. By keeping the overlap of pillars less than the spacing between blast holes, open floor space is available over each pillar to permit drilling blast holes in an entire array below a lower void either from the lower void or from the void immediately overlying the lower void. Thus the maximum overlap of pillars is less than the spacing between blast holes in the array. Such relative alignment of the pillars enables blast holes to be drilled into unfragmented formation below the second void by drilling vertically through such a pillar in the second void. This arrangement permits drilling of blast holes into unfragmented formation below the second void that is occluded by a pillar in the second void.

In the working embodiment, as best illustrated in FIG. 2, each pillar 34 in the air level void 18 has a width less than the spacing between the upper blast holes 42, 42'. This allows the upper blast holes to be drilled down from the air level void along opposite side walls of each pillar in the air level void. Thus, all blast holes drilled through the sill pillar and into the upper zone 24 of unfragmented formation can be drilled from the overlying excavation provided by the air level void. This avoids drilling much longer blast holes through the support pillars 34 in the air level void from an overlying location, such as above ground level.

The outer portions of the pillar 36 in the upper void extend over corresponding inner portions of the pillar 38 in the intermediate void. The width of each portion of the pillar in the upper void which extends over a portion of a pillar in the intermediate void is less than the spacing between blast holes. This facilitates drilling intermediate blast holes into the intermediate zone of unfragmented formation from locations within the upper void adjacent the pillar in the upper void.

Thus, in each zone of unfragmented formation to be explosively expanded, vertical blast holes can be drilled downwardly from the void overlying that zone or from the next void immediately above the void over the zone. That is, in a zone of unfragmented formation below a first void, vertical blast holes can be drilled downwardly directly from the floor of the first void or from the floor of a second void immediately above the first void. Any regions occluded by pillars in the first void are reached by vertical blast holes drilled from the second void downwardly through such pillars. Any pillars in the overlying second void are sufficiently offset horizontally from such a pillar in the underlying void to provide an access region for such drilling. By keeping any horizontal overlap of pillars less than the spacing between blast holes, the entire array of blast holes can be drilled from the two voids.

The pillars 40 within the lower production level void 30 are shown extending below the pillars of the intermediate void by a width less than the spacing between blast holes within the retort site. The portion of each pillar in the lower void which extends below a corresponding pillar 38 in the intermediate void can be greater than the spacing between the blast holes if desired, since the pillars in the production level void do not occlude any blast holes being drilled into unfragmented formation below the production level void. Overlap less than the spacing can be used when it is desired to use vertical blast holes in such production level pillars for explosively expanding such pillars.

The blast holes are loaded with explosive and such explosive is detonated in a single round to explosively expand formation upwardly and downwardly toward the upper void, upwardly and downwardly toward the intermediate void, and downwardly toward the lower void for forming a fragmented permeable mass of formation particles containing oil shale in the in situ retort being formed. According to principles of this invention, explosive expansion upwardly and downwardly toward a given horizontal void is symmetrical. That is, for each horizontal void having upper and lower horizontal free faces toward which formation is explosively expanded, the amount of formation explosively expanded upwardly toward such a void is substantially the same as the amount of formation explosively expanded downwardly toward such a void. In the embodiment illustrated in the drawings, the same amount of formation is expanded upwardly and downwardly toward the upper void 22, and the same amount of formation is explosively expanded upwardly and downwardly toward the intermediate void.

In an embodiment having a plurality of horizontal voids within a retort site wherein formation is explosively expanded upwardly and downwardly toward each horizontal void, substantially the same amount of formation is explosively expanded toward each void. Further, the amount of formation explosively expanded upwardly toward each void is substantially equal to the amount of formation explosively expanded downwardly toward each void.

Symmetrical blasting toward each horizontal void is provided by explosively expanding a substantially uniform depth of formation upwardly and downwardly toward each void across the entire width of such a void. Placement of explosive charges in the blast holes is best understood with reference to FIG. 2. To more clearly illustrate placement of explosive and stemming in the blast holes, the blast holes are shown out of proportion in FIG. 2, i.e., the diameter of the blast holes is actually much smaller in relation to the horizontal dimensions of the retort than is shown in FIG. 2. In the working embodiment, approximately 35 feet of formation, i.e., the entire upper zone 24 of unfragmented formation is explosively expanded downwardly toward the upper void 22 and approximately 35 feet of formation occupying the upper half of the intermediate zone 28 of formation below the floor of the upper void is simultaneously expanded upwardly toward the upper void. Similarly, approximately 35 feet of formation occupying the lower half of the intermediate zone of unfragmented formation above the roof of the intermediate void 26 is explosively expanded downwardly toward the intermediate void while approximately 35 feet of formation occupying the upper portion 32' of the lower zone of unfragmented formation is simultaneously explosively expanded upwardly toward the intermediate void.

The lower portion 32" of the lower zone of unfragmented formation is explosively expanded downwardly toward the lower production level void 30. The proportionate amount of formation explosively expanded downwardly toward the production level void can be less than the proportionate amount of formation explosively expanded upwardly or downwardly toward the upper void or toward the intermediate void to result in a larger void fraction in the portion of the fragmented mass at the elevation of the production level void than the void fraction of the portion of the fragmented mass at the elevation of the intermediate void for example, or than the average void fraction in the fragmented mass.

In the working embodiment, approximately the lower 17.5 feet of the short upper blast holes 42 are loaded with separate columns of explosive 50 up to the top of the upper zone of unfragmented formation, and the top portions 52 of the short upper blast holes, which extend for a depth of about 50 feet through the sill pillar, are stemmed with an inert material such as sand or gravel. Thus, the columns of explosive in the short upper blast holes extend through approximately the upper half of the upper zone of unfragmented formation.

The long upper blast holes 42' are drilled to about 17.5 feet above the roof of the intermediate void, and approximately the bottom 35 feet of these blast holes are loaded with separate lower columns 54 of explosive. Thus, the lower columns of explosive in these blast holes extend through the middle half of the intermediate zone of unfragmented formation. The intermediate portion 56 of each of these blast holes extends through approximately the upper 17.5 feet of the intermediate zone of unfragmented formation, through the 36 feet depth of the support pillar 36 in the upper void, and through approximately the bottom 17.5 feet of the upper zone of unfragmented formation. This intermediate portion 56 of each of the blast holes is stemmed. A separate upper column 58 of explosive approximately 17.5 feet long is loaded above the stemming in each of the intermediate portions of these blast holes. These 17.5 feet long upper columns of explosive extend through the upper half of the upper zone of unfragmented formation, i.e., for approximately the same depth as the explosive columns 50 in the short upper blast holes 42. The remaining upper portions 60 of the long upper blast holes 42', i.e., the portions which extend through the sill pillar, are stemmed.

The short intermediate blast holes 44 are drilled down from the upper void 22 to about 17.5 feet above the roof of the intermediate void, and approximately the bottom 35 feet of these blast holes are loaded with separate columns 62 of explosive. The remaining upper portions 64 of these blast holes extend through approximately the top 17.5 feet of the intermediate zone of unfragmented formation, and this portion of each of the short intermediate blast holes is stemmed. Thus, the columns of explosive in the short intermediate blast holes extend through approximately the middle half of the intermediate zone of unfragmented formation. These columns of explosive correspond to the lower columns 54 of explosive in the longer blast holes drilled from the air level void through the pillar 36 and into the intermediate zone of unfragmented formation.

The long intermediate blast holes 44' are drilled down from the upper void to about 47.5 feet below the floor of the intermediate void, and approximately the lower 30 feet of these blast holes are loaded with lower columns 66 of explosive. Thus, the lower columns of explosive extend through approximately the lower half of the upper portion 32' of the lower zone which is explosively expanded upwardly toward the intermediate void plus the upper half of the lower portions 32" of the lower zone which is explosively expanded downwardly toward the production level void. Intermediate portions 68 of these blast holes extend through approximately the upper 17.5 feet of the lower zone of unfragmented formation, through the entire 36 feet depth of a corresponding pillar 38 in the intermediate void, and through approximately the lower 17.5 feet of the intermediate zone of unfragmented formation. This intermediate portion 68 of each of the long intermediate blast holes is stemmed. Approximately the next 35 feet of each of these blast holes is loaded with an upper column 70 of explosive, and the upper portion 72 of each of these blast holes is stemmed for a depth of approximately 17.5 feet. Thus, the upper columns of explosive extend through approximately the middle half of the intermediate zone of unfragmented formation.

The bottom portions of the lower blast holes 46 are loaded with explosive 74 up to a level approximately 17.5 feet below the floor of the intermediate void. This provides columns 74 of explosive approximately 32.5 feet long in the long lower blast holes 46, columns 74 of explosive approximately 25 feet long in the lower blast holes 46'' in the second band, and columns of explosive approximately 17.5 feet long in the short lower blast holes 46' in the outer band. The upper portions 76 of all the lower blast holes are stemmed for a depth of approximately 17.5 feet below the floor of the intermediate void.

In the embodiment illustrated in FIGS. 1 to 4, relatively long blast holes 42' are drilled downwardly from the air level 18 through the horizontal sill pillar 20, the upper zone 24 of unfragmented formation, the upper pillar 36 in the upper void and into the intermediate zone 28 of unfragmented formation between the upper and lower voids. Such an arrangement using offset pillars permits downhole drilling for all of the blast holes used for explosively expanding formation within the retort site (except for possible use of horizontal blast holes in explosively expanding such pillars). In the alternative a portion of the blast holes can be drilled upwardly into unfragmented formation and loaded with explosive from an underlying void rather than drilling downwardly through a pillar. For example, the columns of explosive 54 could be provided in blast holes drilled upwardly into the intermediate zone 28 from the lower void 26. Having the pillars 38 in the lower void offset from the pillar 36 in the upper void permits access for drilling all of the blast holes needed for the square array of blast holes 44 and 44' in the intermediate zone of unfragmented formation. Similarly uphole drilling and loading can be used for some of the blast holes in the lower zone of unfragmented formation between the production level void 30 and the lower void 26, or for a portion of the blast holes in the upper zone 24 above the upper void 22. Although the offset pillars in vertically spaced apart voids permit such uphole drilling and loading, the downhole drilling and loading hereinabove described and illustrated in FIGS. 1 through 4 is preferred since the downhole drilling and loading techniques are better developed in the art and more easily and economically accomplished.

In the working embodiment, the burden distance to each of the upper and lower horizontal free faces of formation adjacent the upper void is substantially the same, i.e., about 26 feet. The burden distance is measured vertically from the centroid of each column of explosive to the nearest free face. In the intermediate zone of unfragmented formation between the upper and intermediate voids half of the formation is explosively expanded upwardly toward the upper void and half is expanded downwardly toward the intermediate void. The central plane of this zone can be considered to be neutral. The half of each column of explosive above this central plane is about 17.5 feet long and is effective for expanding formation toward the upper void. This upper half of the explosive columns has essentially no effect on formation in the lower half of the intermediate zone. Further, since the hole diameters are all the same the amount of explosive in each blast hole is the same as in each other blast hole in the same zone of unfragmented formation. The effective centroid of each column of explosive expanding formation toward an adjacent void is the same distance from the adjacent free face as each other. The scaled depth of burial (SDOB) of each explosive charge is, therefore, equal to each other charge. Since the scaled depth of burial of the upper and lower explosive charges adjacent the upper void are substantially the same, explosive expansion toward the upper void is symmetrical, that is, the same amount of formation is explosively expanded upwardly and downwardly toward the upper void.

Similarly, since the scaled depth of burial of each of the upper and lower columns of explosive adjacent the intermediate void are substantially the same, the same amount of formation is explosively expanded upwardly and downwardly toward the intermediate void. The effective scaled depth of burial of each half of the explosive columns in the intermediate zone of unfragmented formation is equal. Symmetrical expansion of this zone is therefore obtained. Scaled depth of burial as it applies to cratering or blasting to a horizontal free face is discussed in a paper by Bruce B. Redpath entitled "Application of Cratering Characteristics to Conventional Blast Design," a copy of which accompanies this application. The scaled depth of burial of an explosive charge can be expressed in units of distance over weight or preferably energy of explosive to the one third power ($d/w^{\frac{1}{3}}$). The distance (referred to as burden distance) in the equation for SDOB is measured from the free face to the effective centroid of the explosive. The weight or energy is the total for the column of explosive. In the working embodiment the centroid of the explosive column in each blast hole is about 11 mm/cal$^{\frac{1}{3}}$. The effective centroid of each column of explosive is about eight meters from the free face and the energy of each is about $3.85 \times 10^8$ calories.

The scaled depth of burial for an array of columns of explosive can be less than the scaled depth of burial of the individual explosive charges since interaction between the explosive charges can occur upon detonation. The same effective scaled depth of burial for an array of explosive charges can be obtained with a variety of patterns of blast holes. Thus, for example, the same effective scaled depth of burial can be obtained with either (a) relatively large charges at relatively wide spacing between holes, or (b) relatively smaller charges at relatively smaller spacing between holes. What is desired is that the effective scaled depth of burial of the arrays of explosive on each side of a void are substantially the same.

Detonation of each explosive charge is initiated remote from end of the column of explosive nearest the free face toward which formation is explosively expanded when the explosive is detonated. When so detonated the direction of propagation of detonation through explosive is toward the free face. In the working embodiment, separate detonators (represented by an x at 80 in FIG. 2) are placed above the columns of explosive 50 and 58 in the blast holes in the upper zone of unfragmented formation. Thus, each of these detonators is at the same level, namely, at the top of the upper zone of unfragmented formation, approximately 35 feet from the upper free face adjacent the upper void. Detonation of explosive in the upper blast holes is initiated such that the direction of propagation of detonation is toward the upper free face adjacent the upper void.

In the intermediate zone of unfragmented formation, a detonator or a plurality of detonators for redundancy, (represented by an x at 82 in FIG. 2) is placed in the center of each column of explosive for initiating detonation of such explosive upwardly toward the upper void and downwardly toward the lower void. These detonators are positioned at a level approximately mid-way between the lower free face of formation adjacent the upper void and the upper free face of formation adjacent the lower void. The detonators are initiated so that equal amounts of formation are explosively expanded upwardly toward the upper void and downwardly toward the lower void. Detonation is initiated in the middle of the intermediate zone so that detonation propagates toward each of the two adjacent free faces, and such initiation results in a better cratering effect than initiation at other points within the intermediate zone.

Thus, in each of these two zones of unfragmented formation, detonation of each explosive charge is initiated remote from the free face toward which formation is expanded. There are two situations as described herein where detonation is initiated remote from the free face.

The first of these situations is in the upper zone of unfragmented formation where explosive expansion is only in one direction, i.e., downwardly toward the upper void. In this situation the detonators are located at the end of the column of explosive furthest from the free face at the roof of the upper void. This location is most remote from the free face.

In the second situation a column of explosive is provided midway between two free faces, as for example in the intermediate zone of unfragmented formation between the upper void and the lower void. In this situation detonation is initiated at the mid point of the column of explosives about half way between the two free faces. This location is most remote from each free face with respect to that portion of the column of explosive which expands formation towards the respective free face.

In either situation the detonators may actually be located a small distance from the most remote portion of the column of explosive. For example, in the first situation, the detonator may be a foot or so from the end of the column of explosive to assure that it is buried in the explosive for reliable detonation. Similarly, detonators located at the mid point of the column of explosive, as in the intermediate zone, can be located somewhat off center due to errors in measurement or placement. Such deviations are routine and have minimal effect on the resulting explosive expansion. Even with such deviations from precise location of the detonators the direction of propagation of detonation in the explosive is substantially towards the respective free face.

Separate detonators (represented by an x at 84 in FIG. 2) are placed at about the same level in the columns of explosive in the lower zone of unfragmented formation, namely, about 35 feet below the lower free face adjacent the intermediate void. Detonation of explosive in the lower blast holes is initiated such that the direction of propagation of detonation is upwardly toward the lower free face adjacent the intermediate void. Detonation the portions of the lower blast holes above the production level void propagates toward the free face at the roof of the production level void for explosive expansion of formation within the lower portion 32″ of the lower zone toward the production level void.

Explosive is also placed in the support pillars in the upper, intermediate and lower voids. Horizontally extending blast holes (not shown) can be drilled in the pillars and such blast holes are loaded with explosive in preparation for explosively expanding the pillars. A variety of arrangements of horizontal blast holes can be used depending on the size and shape of the pillars. Alternatively, the vertical blast holes drilled through the pillars can be loaded with explosive charges, as illustrated in FIG. 7. Sufficient explosive is placed in the pillars to explosively expand all of each pillar toward its respective void. It is desired to detonate explosive in the larger single pillar in the upper void shortly before detonating explosive in the smaller pair of pillars in the intermediate void to better distribute fragments of the pillars across the voids. It is also desirable to detonate explosive in all the pillars (those in the upper, intermediate and production level voids) before detonating explosive in the zones of unfragmented formation within the retort site so that the pillars do not interfere with explosive expansion of the zones of unfragmented formation. Thus, explosive in the zones of unfragmented formation is not detonated until shortly after the pillars have been explosively expanded to create a substantially continuous free face of formation adjacent the top and bottom of each horizontal void. The pillars 40 in the production level void can be explosively expanded a substantial time before expanding the balance of formation at the retort site since the roof span of this void is small enough that the roof will remain in place for at least many weeks or months.

Following explosive loading within the retort site, explosive is detonated in a single round of explosions for explosively expanding the unfragmented zones toward the horizontal free faces of formation adjacent the voids for forming a fragmented permeable mass 86 (see FIG. 5) of formation particles containing oil shale in an in situ oil shale retort. Explosive in the larger pillar 36 in the upper void is detonated first, followed a short time later by detonation of explosive in the smaller pillars 38 in the intermediate void. About 100 milliseconds after detonation of the last explosive in the pillars, detonation of explosive in the zones of formation to be expanded toward the voids commences. Time delays are employed in the blast holes in each zone so that the amount of explosive detonating in each delay interval is minimized. The total time to execute the single round during which the pillars 36 and 38 and the zones of formation 24, 26 and 32 are expanded is less than one half second.

The symmetrical blasting pattern of this invention enhances the chance of production of a generally uniformly distributed void fraction in the fragmented mass. The same amount of formation is expanded toward each void and the same amount of formation is expanded from above and below each of the voids. The symmetrical blasting arrangement also enhances predictability of effects of such parameters as powder factor, time delay values, etc., on the uniformity of particle size in the fragmented mass.

Figure 5:
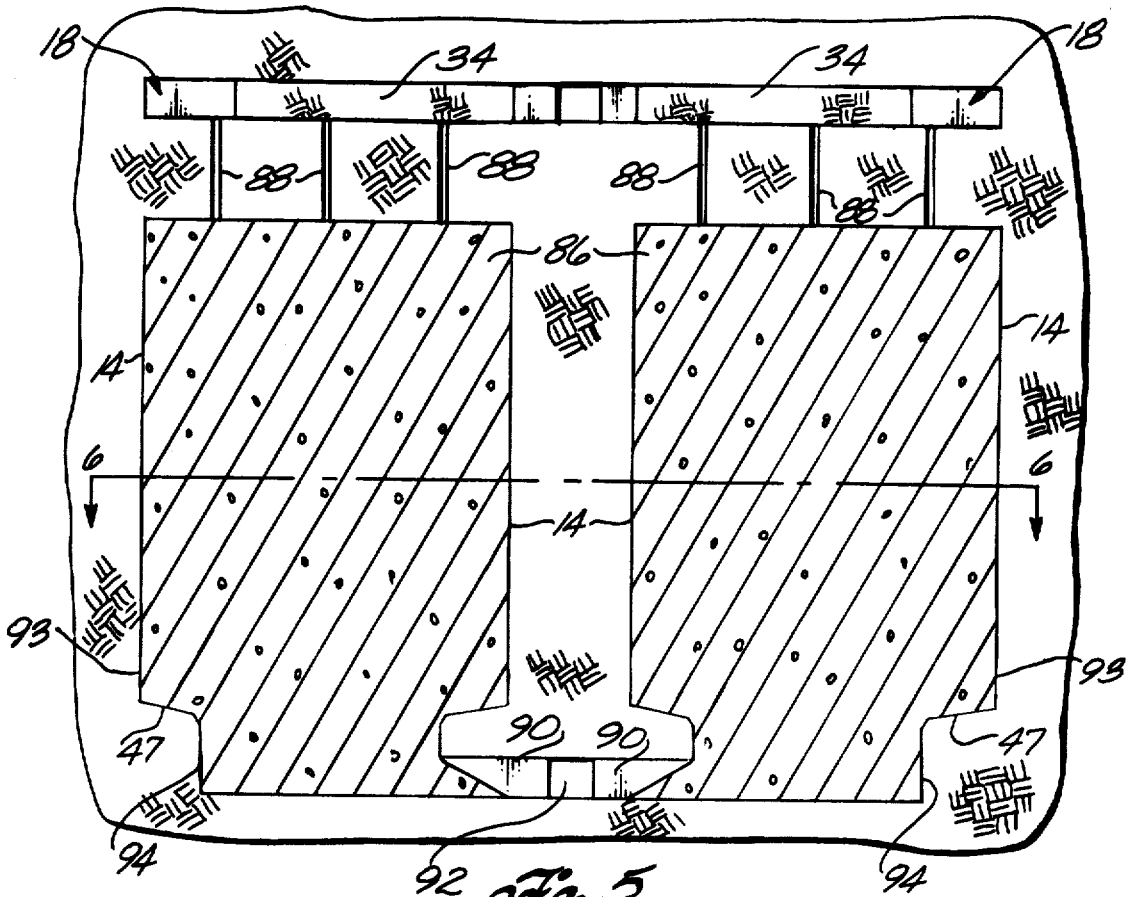
FIG. 5 is a fragmentary, semi-schematic vertical cross-sectional view showing a pair of completed in situ retorts formed according to principles of this invention.

FIG. 5 illustrates a pair of horizontally spaced apart adjacent retorts each containing a fragmented permeable mass of formation particles containing oil shale. After forming each fragmented mass, the final preparation steps for producing liquid and gaseous products from each retort are carried out. These include drilling a plurality of feed gas inlet passages 88 downwardly from the air level void to the top boundary of each fragmented mass so that oxygen supplying gas can be introduced into each fragmented mass during retorting operations. Alternatively at least a portion of the blast holes through the sill pillar are used for introduction of oxygen supplying gas. A separate horizontally extending product withdrawal drift 90 extends away from a lower portion of each fragmented mass at the lower production level, and each product withdrawal drift opens into opposite sides of a main production level drift 92 for removal of liquid and gaseous products from the bottom of the retorts.The product withdrawal drifts are downwardly inclined toward the main production level drift 92 so that liquid products of retorting can flow down toward the main production level drift.

During retorting operations, a combustion zone is established in each fragmented mass, and the combustion zone is advanced downwardly through each fragmented mass by introducing an oxygen supplying gas into the fragmented mass. Combustion gas produced in the combustion zone passes through the fragmented mass to establish a retorting zone on the advancing side of the combustion zone, wherein kerogen in the oil shale is retorted to produce liquid and gaseous products of retorting. The liquid products and an off gas containing gaseous products pass to the bottom of the fragmented mass and are withdrawn to the main production level drift through the separate product withdrawal drifts. Liquid products can flow toward the end of the main production level drift and are collected in a sump (not shown) at the end of the main drift. A pump (not shown) is used to withdraw liquid products from the sump to above ground. Off gas is withdrawn from the production level by a blower (not shown) and passed to above ground.

Figure 6:
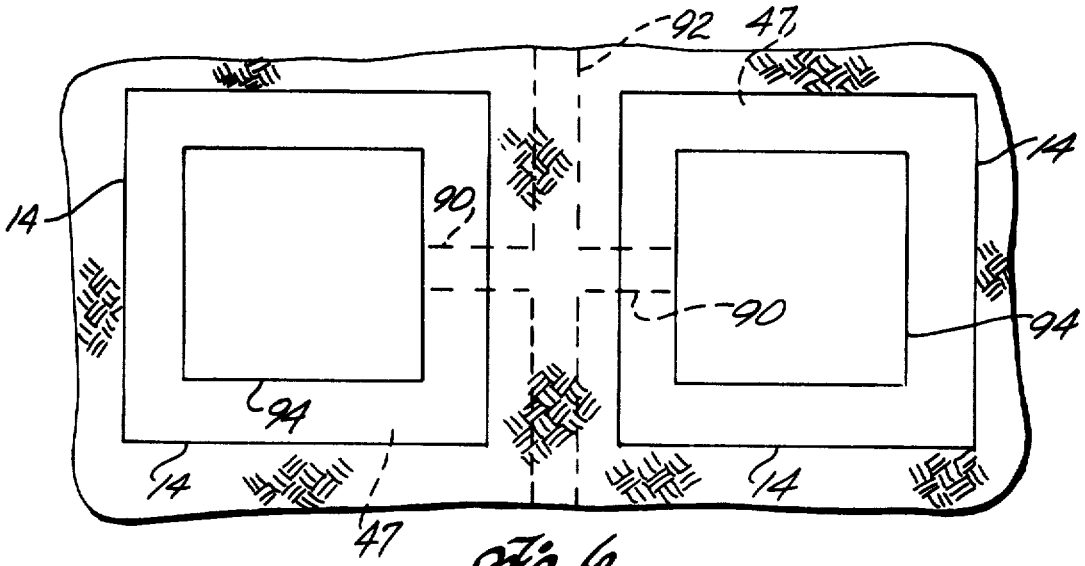
FIG. 6 is a fragmentary, semi-schematic horizontal cross-sectional view taken on line 6—6 of FIG. 5.

The fragmented mass in each retort is formed with a generally T-shaped bottom near the production level. Such a T-shaped bottom is best illustrated in the vertical cross-section of the fragmented mass shown in FIG. 5 and in the horizontal cross-section of the fragmented mass shown in FIG. 6 wherein the fragmented formation particles are deleted for clarity of illustration.

The T-shaped bottom is formed by initially excavating the upper and intermediate voids with a horizontal cross-sectional area substantially greater than the horizontal cross-sectional area of the production level void. In one embodiment, the area of the production level void is between about 30% to about 70% of the area of the upper and intermediate voids.

In the embodiment shown, the production level void does not extend below the two outer bands of lower blast holes 46', 46" drilled in the upper portion 32' of the lower zone of unfragmented formation. Thus, detonation of explosive charges in these two outer bands of blast holes explosively expands formation only in an upward direction toward the lower free face adjacent the intermediate void. Detonation of explosive in the remaining longer lower blast holes 46 explosively expands formation from the lower zone upwardly and downwardly toward the intermediate void and the production level void, respectively. This forms a fragmented mass having a lower portion with the vertical cross-section shaped generally as a T. In the working embodiment, the cross bar of the T is about 160 feet wide, 160 feet long, formed by explosive expansion of formation within the upper portion 32' of the lower zone of unfragmented formation and upper portions of the retort. The leg of the T is about 100 feet wide, 100 feet long and about 45 to 50 feet high and is formed primarily by explosive expansion of formation within the lower portion 32" of the lower zone of unfragmented formation downwardly toward the production level void. The cross bar of the T is illustrated at 93 in FIG. 5, and the leg of the T is illustrated at 94 in FIGS. 5 and 6. Thus, in this embodiment the horizontal cross-sectional area of the fragmented mass in the leg of the T about 40% of the horizontal cross-sectional area in upper regions of the fragmented mass. Since the blast holes extending downwardly adjacent the intersection of the cross bar and leg of the T-shaped bottom are of differing length, as described above, the bottom boundary 47 slopes gently toward the leg of the T and the corners of the T-shaped bottom of the fragmented mass are slightly beveled. This provides a somewhat inwardly sloping step at the transition between the 160-foot wide upper portion of the fragmented mass above the production level and the 100-foot wide lower portion of the fragmented mass nearer the production level. The bottom boundary of the retort is stepped with a relatively higher elevation sloping step 47 surrounding the lower level floor of the production level void. The sides of the bottom portion between the floor at the elevation of the production level drift and the elevation of the step extend substantially vertically.

The void volume of the production level void relative to the amount of formation explosively expanded toward the void is substantially greater than the void volume of the intermediate void relative to the amount of formation explosively expanded toward the intermediate void. This results in a higher void fraction in the fragmented mass in the T-shaped bottom than the average void fraction in the balance of the fragmented mass. In the working embodiment, the void fraction of the fragmented mass in the leg of the T is about 35%, whereas the void fraction in higher elevations of the fragmented mass is about 23% to 25%.

The T-shaped bottom of the fragmented mass avoids creating a substantial constriction in the horizontal cross-sectional area of the fragmented mass through which gaseous products of retorting pass near the production level. For example, a much narrower funnel-shaped bottom at the production level of a fragmented mass can produce a large constriction in the horizontal cross-sectional area through which gaseous products of retorting flow as they are being withdrawn from the fragmented mass. Such a large constriction to gas flow in the lower portion of the fragmented mass can increase gas velocities near the production level to as much as 5 to 10 times the gas velocities in upper elevations of the fragmented mass. Such a high gas velocity at the production level can entrain shale oil droplets in the gas being withdrawn from the bottom of the fragmented mass, producing aerosols which are withdrawn in the off gas from the fragmented mass. The T-shaped bottom of the fragmented mass avoids such large increases in gas velocity near the production level. Since the horizontal cross-sectional area of the leg of the T is at least about 30% of the horizontal cross-sectional area in the upper portions of the fragmented mass and the void fraction near the production level is appreciably higher than the void fraction in other portions of the fragmented mass, a substantial constriction at the production level of the fragmented mass is avoided. The T-shaped bottom results in gas velocities in the lower portion of the fragmented mass which are not more than about three times the gas velocity in upper elevations of the fragmented mass. This substantially avoids appreciable amounts of shale oil being withdrawn as an aerosol in the retort off gas.

If the cross-sectional area of the production level void, and hence the fragmented mass in the leg of the T-shaped bottom, is less than about 30% of the cross-sectional area of the fragmented mass in upper parts of the retort, the gas velocity increase due to constriction at the bottom can result in excessive aerosol entrainment in the retort off gas. Preferably, the cross-sectional area of the fragmented mass in the T-shaped bottom is less than about 70% of the cross-sectional area in upper portions of the retort. This area provides ample cross-section for gas flow to minimize aerosol entrainment and excess mining costs are avoided. Access drifts are provided at the elevation of the production level void and hence adjacent the T-shaped bottom. These drifts remain open during the productive life of adjacent retorts and sufficient unfragmented formation is left around the drifts to provide long term stability and resistance to damage during retort formation. If the T-shaped bottom portion has an area greater than about 70% of the horizontal cross-sectional area of upper portions of the retort, insufficient unfragmented formation can remain along the production level drifts.

The T-shaped bottom on the retort also helps minimize combustion zone skewing as a combustion zone advances downwardly through the fragmented mass in the retort. When retorting off gas is withdrawn from an edge at the bottom of an in situ retort, gas flow can be larger near the edge than elsewhere in the fragmented mass and a combustion zone can become skewed. The T-shaped bottom helps distribute gas flow more uniformly across the retort cross-section and minimizes such skewing.

FIG. 7 shows an alternative retort forming technique using a horizontal free face system of symmetrical blasting and horizontally offset pillars. The mining system shown in FIG. 7 also provides a fragmented mass having a T-shaped bottom. In the technique shown in FIG. 7, the fragmented mass being formed is greater in height than the fragmented mass illustrated in FIGS. 1 to 6. The technique illustrated in FIG. 7 includes an air level void 118, a sill pillar 120 below the air level void, an upper zone of unfragmented formation 124 above an upper horizontal void 122, an upper intermediate zone of unfragmented formation 125 above an upper intermediate void 127, a lower intermediate zone 129 of unfragmented formation above a lower intermediate horizontal void 131, and a lower zone 132 of unfragmented formation above a production level void 130. The air level void, the upper void and the upper and lower intermediate voids are similar in horizontal cross-section to the horizontal cross-section of the fragmented mass being formed; and the horizontal cross-sectional area of the production level void 130 is about 30% to about 50% that of the voids above it. The production level void is offset horizontally somewhat when compared with the position of the horizontal void 30 in the retort shown in FIGS. 1 through 6 so that the drift between the retorts has an additional amount of unfragmented formation adjacent the drift for overburden support.

Each support pillar 136 in the upper void 122 is offset horizontally relative to at least a portion of a corresponding pillar 134 located in the air level void immediately above the pillar in the upper void. This provides an open floor space in the air level void for providing access for drilling one or more vertical blast holes 142 downwardly from the air level void through the pillars 136 in the upper void and into the zone 125 of unfragmented formation below the upper void.

Similarly, the central portion of a pillar 137 in the upper intermediate void is located below an open floor space in the upper void between the two pillars 136 in the upper void. This provides an access region in the upper void for drilling one or more blast holes 144 down from the upper void through the pillar 137 in the upper intermediate void and into unfragmented formation in the lower intermediate zone 129 of unfragmented formation.

The lower intermediate void includes a pair of horizontally spaced apart support pillars 139 extending below outer portions of the pillar 137 in the upper intermediate void. An open floor space in the upper intermediate void provides access for drilling one or more lower intermediate blast holes 143 down from the floor of the upper intermediate void through each pillar 139 in the lower intermediate void and into the lower zone 132 of unfragmented formation. An open floor space in the lower intermediate void between the pillars 139 provides access for drilling vertical lower blast holes 146 into the lower zone of unfragmented formation.

The horizontally offset pillars in the mining arrangement illustrated in FIG. 7 are similar to those illustrated in FIGS. 1 to 6, in that vertical blast holes can be drilled down into all regions of unfragmented formation within the retort site from an adjacent overlying excavation, except for those portions of unfragmented formation occluded by the support pillars, in which instances these regions of formation can be reached by vertical blast holes drilled down through only one support pillar from an overlying excavation immediately above the excavation in which such a pillar is located.

The mining arrangement illustrated in FIG. 7 also provides a symmetrical blasting scheme similar to that illustrated in FIGS. 1 to 6. That is, vertical blast holes drilled in the upper zone of unfragmented formation are loaded with columns of explosive 149 extending through the upper half of the upper zone of unfragmented formation. Vertical blast holes drilled in the upper intermediate zone of unfragmented formation are loaded with columns of explosive 145 extending through approximately the middle half of the upper intermediate zone of unfragmented formation. Vertical blast holes drilled through the lower intermediate zone of unfragmented formation are loaded with columns of explosive 149 extending through the middle half of the lower intermediate zone of unfragmented formation.

The lower zone of unfragmented formation has an upper portion 132' of substantially uniform thickness extending across substantially the entire width of the retort being formed. The lower zone also includes a lower portion 132'' of substantially uniform thickness which is reduced in width relative to the width of the upper portion 132' of the lower zone. An outer group of the vertical blast holes drilled in the lower zone of unfragmented formation define the lower boundary 147 of the fragmented mass being formed. The lengths of the outer blast holes are progressively longer as the rows of blast holes approach the center of the retort, as illustrated in FIG. 7. This provides a sloping step between a wider upper portion and a narrower leg of a T-shaped bottom of the fragmented mass being formed. An inner group of the vertical blast holes drilled in the lower zone are longer than the outer group of the blast holes. These longer blast holes extend entirely through the upper portion 132' of the lower zone and half way through the lower portion 132" of the lower zone above the production level void 130. The blast holes in the outermost band drilled in the lower zone of unfragmented formation are loaded with explosive charges 174 extending through one half of the depth of the upper portion of the lower zone, and the inner group of the blast holes in the lower zone have explosive charges extending through half of the upper portion 132' plus half of the lower portion 132" of the lower zone. Blast holes in the band or bands between the perimeter band and the inner group of blast holes are drilled and loaded to intermediate depths.

Explosive within the retort site shown in FIG. 7 is explosively expanded in a single round of explosions and in a symmetrical blasting arrangement in which the amount of formation explosively expanded downwardly and upwardly toward the upper, the upper intermediate and the lower intermediate voids is substantially the same, similar to the techniques of symmetrical blasting described for the retort shown in FIGS. 1 through 6.

Explosive expansion of formation in the lower zone of unfragmented formation for the retort of FIG. 7 forms a T-shaped bottom of the fragmented mass similar to that shown for the retort in FIGS. 1 through 6.

In the embodiments hereinabove described, the dimensions of the voids and the zones of unfragmented formation, and blast hole depths are stated with a degree of precision essentially unattainable in practical mining operations. Thus, for example, the depth of blast holes is stated as the desired value, sometimes to one-half foot. Discrepancies of a foot or two in the depth of such blast holes are not unexpected and have an insignificant effect on the formation of a retort. Similarly, moderate angular deviations can be tolerated in the vertical blast holes since the effect on spacing between blast holes is not great.

Likewise, the height of a void or the thickness of a zone of unfragmented formation between adjacent voids can differ from the design value due to practical mining constraints. Preferably a void is excavated with its roof at a stratum that is sufficiently competent to provide safe working conditions in the void during the time period required for forming a retort. A floor level for a void may also be sought where a smooth parting is obtained to ease blasting and loading operations. The result can be deviation from the designed symmetry. Thus, for example, in one practical example of symmetrical explosive expansion of oil shale to form an in situ retort, the volume of oil shale expanded downwardly towards an excavated void was estimated to be about 10% greater than the volume of oil shale expanded upwardly toward that void.

In the embodiment illustrated in FIG. 7 the production level void and hence the T-shaped bottom portion of the retort is offset towards one side instead of being symmetrically located as in the embodiments of FIGS. 1 to 6. If desired the production level void and hence the T-shaped bottom portion of the retort can be offset so that one or more walls of the bottom portion adjacent the production level void are essential coplanar with side boundaries of the retort. In such an embodiment the "outer band" of blast holes drilled to the bottom boundary of the retort for explosively expanding formation upwardly toward the lower void extends along only one or more sides of the T-shaped bottom instead of circumscribing the production level void. In such an embodiment the higher level step at the bottom of the retort is present along only a portion of the edge of the lower level floor. This might be considered an L-shaped bottom in some vertical planes, however, for purposes of this description it is still considered a T-shaped bottom.

What is claimed is:

1. A method for recovering liquid and gaseous products from an in situ oil shale retort formed in a retort site in a subterranean formation containing oil shale, such an in situ oil shale retort containing a fragmented permeable mass of formation particles containing oil shale, comprising the steps of:

excavating formation from within the retort site for forming at least one void extending horizontally across the retort site, leaving an upper zone of unfragmented formation within the retort site immediately above the void, and leaving a lower zone of unfragmented formation within the retort site immediately below the void, the lower zone having substantially the same vertical height as the upper zone;

placing explosive in mutually spaced apart vertical upper blast holes in the upper zone of unfragmented formation, and placing explosive in mutually spaced apart vertical lower blast holes in the lower zone of unfragmented formation;

initiating detonation of explosive in each of the upper and lower blast holes in a single round, such detonation being initiated at substantially the same vertical distance from the void for explosively expanding substantially the same amount of formation from the upper zone downwardly toward the void that is explosively expanded from the lower zone upwardly toward the void for forming a fragmented permeable mass of formation particles containing oil shale in an in situ oil shale retort;

establishing a retorting zone in an upper portion of the fragmented mass;

introducing a retorting gas into the fragmented mass for sustaining the retorting zone and for advancing the retorting zone through the fragmented mass; and withdrawing liquid and gaseous products of retorting from a lower portion of the fragmented mass on the advancing side of the retorting zone.

2. The method according to claim 1 including placing a separate detonator in explosive in each of the upper and lower blast holes such that the direction of propagation of detonation in the explosive in each blast hole is toward the void.

3. The method according to claim 1 including placing a separate column of explosive in each of the upper and lower blast holes, and in which the columns of explosive in the upper blast holes are have substantially the same effective scaled depth of burial from the void as the columns of explosive in the lower blast holes.

4. The method according to claim 3 including placing such explosive in equal size charges in substantially equidistantly spaced apart upper and lower blast holes in square arrays, the spacing between adjacent upper blast holes being substantially the same as the spacing between lower blast holes.

5. The method according to claim 1 including placing explosive in each upper blast hole at substantially the same burden distance from the void as explosive placed in each lower blast hole.

6. A method for forming an in situ oil shale retort in a retort site within a subterranean formation containing oil shale, such an in situ oil shale retort containing a fragmented permeable mass of formation particles containing oil shale, comprising the steps of:

excavating formation from within the retort site for forming at least one void extending horizontally across the retort site, leaving an upper zone of unfragmented formation within the retort site immediately above the void, and leaving a lower zone of unfragmented formation within the retort site immediately below the void, the upper and lower zones of unfragmented formation providing upper and lower horizontal free faces of formation, respectively, adjacent the void;

drilling an array of vertical upper blast holes in the upper zone of unfragmented formation;

drilling an array of vertical lower blast holes in the lower zone of unfragmented formation;

placing separate explosive charges in each of the upper and lower blast holes;

placing a separate detonator in explosive in each of the upper and lower blast holes such that the direction of propagation of detonation in explosive in the upper and lower blast holes is toward the upper and lower free faces, respectively; and detonating the explosive in the upper and lower blast holes in a single round for explosively expanding a substantially uniform depth of formation adjacent the upper free face downwardly toward the void and for explosively expanding substantially the same amount and substantially the same uniform depth of formation adjacent the lower free face upwardly toward the void for forming a fragmented permeable mass of formation particles containing oil shale in an in situ oil shale retort.

7. The method according to claim 6 including initiating detonation of explosive in the upper and lower blast holes at substantially the same distance from the upper and lower free faces, respectively.

8. The method according to claim 6 wherein the explosive charges comprise separate columns of explosive in each of the upper and lower blast holes, explosive columns in the upper blast holes having the same effective scaled depth of burial from the upper free face as the explosive columns in the lower blast holes have from the lower free face.

9. The method according to claim 8 including initiating detonation in the upper and lower blast holes at substantially the same vertical distance from the upper and lower free faces, respectively.

10. The method according to claim 6 including:

placing explosive in the upper and lower blast holes to form vertical columns of explosive;

placing a first such detonator in explosive within each of the upper blast holes; and placing a second such detonator in explosive within each of the lower blast holes, the first detonators being located substantially the same distance from the upper free face that the second detonators are located from the lower free face.

11. In a method for forming an in situ oil shale retort in a retort site within a subterranean formation containing oil shale, the in situ oil shale retort containing a fragmented permeable mass of formation particles containing oil shale, wherein the fragmented mass is formed by excavating formation from within the retort site for forming a void having a horizontal cross-section substantially similar to the horizontal cross-section of the fragmented mass being formed, leaving an upper zone of unfragmented formation having a lower free face of formation above the void, and leaving a lower zone of unfragmented formation having an upper free face of formation below the void, the improvement comprising:

placing columnar explosive charges in the upper zone at a selected distance from the lower free face, and placing columnar explosive charges in the lower zone at substantially the same selected distance from the upper free face; and detonating the explosive charges in the upper and lower zones in a single round at substantially the same distance from their corresponding free faces so that propagation of detonation in the columns of explosive propagates toward the free faces for explosively expanding substantially the same amount of formation downwardly from the upper zone toward the lower free face that is explosively expanded upwardly from the lower zone toward the upper free face for forming a fragmented permeable mass of formation particles containing oil shale in the in situ oil shale retort.

12. The improvement according to claim 11 wherein the columnar explosive charges in the upper zone have substantially the same effective scaled depth of burial from the lower free face as the columnar explosive charges in the lower zone have from the upper free face.

13. A method for forming an in situ oil shale retort in a retort site within a subterranean formation containing oil shale, such an in situ oil shale retort containing a fragmented permeable mass of formation particles containing oil shale, comprising the steps of:

excavating formation from within the retort site for forming at least one void extending horizontally across the retort site, leaving an upper zone of unfragmented formation within the retort site above the void, and leaving a lower zone of unfragmented formation within the retort site below the void, the upper and lower zones of unfragmented formation providing upper and lower horizontal free faces of formation, respectively, adjacent the void;

drilling an array of vertical upper blast holes in the upper zone of unfragmented formation perpendicular to the upper free face;

drilling an array of vertical lower blast holes in the lower zone of unfragmented formation perpendicular to the lower free face;

placing separate columns of explosive in each of the upper and lower blast holes, the explosive in the upper blast holes having substantially the same effective scaled depth of burial from the upper free face as the explosive in the lower blast holes has from the lower free face; and detonating explosive in the upper and lower blast holes in a single round for explosively expanding substantially the same amount of formation adjacent the upper free face downwardly toward the void that is explosively expanded adjacent the lower free face upwardly toward the void for forming a fragmented permeable mass of formation particles containing oil shale in an in situ oil shale retort, such detonation in each blast hole being initiated at substantially the same vertical distance from the adjacent free face as each other blast hole.

14. The method according to claim 13 including placing a separate detonator in explosive in each of the upper and lower blast holes such that the direction of propagation of detonation in explosive in the upper and lower blast holes is toward the upper and lower free faces, respectively.

15. A method for forming an in situ oil shale retort in a retort site within a subterranean formation containing oil shale, such an in situ oil shale retort containing a fragmented permeable mass of formation particles containing oil shale, comprising the steps of:

excavating formation from within the retort site for forming an upper void extending horizontally across an upper level within the retort site, leaving an upper zone of unfragmented formation within the retort site immediately above the upper void;

excavating formation from within the retort site for forming a lower void extending horizontally across a lower level within the retort site spaced directly below the upper void, leaving an intermediate zone of unfragmented formation within the retort site extending from the upper void to the lower void, and leaving a lower zone of unfragmented formation within the retort site immediately below the lower void, the excavated volume of the lower void being about the same as the excavated volume of the upper void; and detonating explosive in the upper, intermediate and lower zones in a single round for explosively expanding an amount of formation from within the upper zone downwardly toward the upper void, for explosively expanding an amount of formation from within an upper portion of the intermediate zone upwardly toward the upper void, for explosively expanding an amount of formation from within a lower portion of the intermediate zone downwardly toward the lower void, and for explosively expanding an amount of formation from within the lower zone upwardly toward the lower void, the amounts of formation explosively expanded from within the upper zone, the upper and lower portions of the intermediate zone and the lower zone being substantially equal to one another for forming a fragmented permeable mass of formation particles containing oil shale within an in situ oil shale retort.

16. The method according to claim 15 including placing explosive in an array of vertical upper blast holes in the upper zone of unfragmented formation; placing explosive in an array of vertical intermediate blast holes in the intermediate zone of unfragmented formation; placing explosive in an array of vertical lower blast holes in the lower zone of unfragmented formation; initiating detonation of explosive in the upper and lower blast holes remote from the upper and lower voids, respectively; and initiating detonation of explosive in the intermediate blast holes substantially half way between the upper and lower voids.

17. The method according to claim 16 including initiating detonation of explosive in the upper and lower blast holes at substantially the same distance from the upper and lower voids, respectively; and initiating detonation of explosive in the intermediate blast holes at the same vertical distance from the upper and lower voids that detonation of explosive in the upper and lower blast holes is initiated from the upper and lower voids, respectively.

18. The method according to claim 17 including placing a separate detonator in explosive in each of the upper and lower blast holes such that the direction of propagation of detonation in explosive in the upper and lower blast holes is toward the upper and lower voids, respectively; and placing separate detonators in explosive in each of the intermediate blast holes such that the direction of propagation of detonation in explosive in the intermediate blast holes is toward both the upper void and the lower void.

19. The method according to claim 15 wherein the excavated portion of the lower void has the same horizontal cross-sectional area and the same height as the horizontal cross-sectional area and height of the excavated portion of the upper void.

20. A method for forming an in situ oil shale retort in a retort site within a subterranean formation containing oil shale, such an in situ oil shale retort containing a fragmented permeable mass of formation particles containing oil shale, comprising the steps of:

excavating formation from within the retort site for forming an upper void extending horizontally across an upper level within the retort site leaving an upper zone of unfragmented formation within the retort site adjacent an upper free face above the upper void;

excavating formation from within the retort site for forming a lower void extending horizontally across a lower level within the retort site spaced directly below the upper void, leaving a lower zone of unfragmented formation within the retort site adjacent a lower free face below the lower void, and leaving an intermediate zone of unfragmented formation within the retort site extending from a lower free face of the upper void to an upper free face of the lower void, the height of the upper zone being substantially the same as the height of the lower zone, the height of the intermediate zone being about twice the height of the upper zone;

drilling a plurality of vertical upper blast holes in the upper zone, drilling a plurality of vertical intermediate blast holes in the intermediate zone, and drilling a plurality of vertical lower blast holes in the lower zone;

placing separate columns of explosive in the upper blast holes extending through approximately the upper half of the upper zone, placing separate columns of explosive in the lower blast holes extending through approximately the lower half of the lower zone, and placing separate columns of explosive in the intermediate blast holes extending through approximately the middle half of the intermediate zone; and detonating the explosive in the upper, intermediate and lower blast holes in a single round for explosively expanding formation within the upper and lower zones downwardly and upwardly, respectively, toward the upper and lower voids and for explosively expanding formation within the intermediate zone upwardly and downwardly toward the upper and lower voids, respectively, substantially the same amount of formation being explosively expanded from within the upper zone downwardly toward the upper void, from within the intermediate zone upwardly toward the upper void, from within the lower zone upwardly toward the lower void, and from within the intermediate zone downwardly toward the lower void for forming a fragmented permeable mass of formation particles containing oil shale in an in situ oil shale retort.

21. The method according to claim 20 wherein detonation of explosive in the intermediate zone is initiated at the middle of the intermediate zone, and detonation of explosive in the upper and lower blast holes is initiated at substantially the same vertical distance from the upper and lower voids, respectively, as initiation of explosive in the intermediate zone is from either the upper void or the lower void.

22. A method according to claim 20 including initating detonation of explosive at the upper ends of the explosive columns in the upper blast holes and at the middle of the explosive columns in the intermediate blast holes.

23. The method according to claim 20 wherein explosive placed in the upper blast holes is at substantially the same effective scaled depth of burial from the upper free face of the upper void that the explosive in the intermediate blast holes is from the lower free face of the upper void; and in which explosive placed in the lower blast holes is at substantially the same effective scaled depth of burial from the lower free face of the lower void that the explosive in the intermediate blast holes is from the upper free face of the lower void.

24. The method according to claim 20 in which columns of explosive in the intermediate blast holes are twice as long as columns of explosive in the upper blast holes and in the lower blast holes.

25. A method for forming an in situ oil shale retort in a retort site within a subterranean formation containing oil shale, such an in situ oil shale retort containing a fragmented permeable mass of formation particles containing oil shale, comprising the steps of:

excavating formation from within the retort site for forming an upper void extending horizontally across an upper level within the retort site, leaving an upper zone of unfragmented formation adjacent a horizontal upper free face adjacent the upper void;

excavating formation from within the retort site for forming an intermediate void extending horizontally across an intermediate level within the retort site directly below the upper void, leaving an upper intermediate zone of unfragmented formation between a lower horizontal free face adjacent the upper void and a horizontal upper free face adjacent the intermediate void, the excavated volume of the intermediate void being about the same as the excavated volume of the upper void;

excavating formation from within the retort site for forming a lower void extending horizontally across a lower level within the retort site directly below the intermediate void, leaving a lower intermediate zone of unfragmented formation between a horizontal lower free face adjacent the intermediate void and a horizontal upper free face adjacent the lower void, and leaving a lower zone of unfragmented formation below a horizontal lower free face adjacent the lower void, the excavated volume of the lower void being about the same as the excavated volume of the upper void;

drilling an array of vertical upper blast holes in the upper zone of unfragmented formation extending perpendicularly to the upper free face adjacent the upper void;

drilling an array of vertical upper intermediate blast holes in the upper intermediate zone of unfragmented formation extending perpendicularly to the lower free face adjacent the upper void;

drilling an array of vertical lower intermediate blast holes in the lower intermediate zone of unfragmented formation extending perpendicularly to the lower free face adjacent the intermediate void;

drilling an array of vertical lower blast holes in the lower zone of unfragmented formation extending perpendicularly to the lower free face adjacent the lower void;

placing separate columns of explosive in each of the blast holes in the upper, upper intermediate, lower intermediate and lower zones of unfragmented formation; and detonating the columns of explosive in the upper, upper intermediate, lower intermediate and lower zones of unfragmented formation in a single round for explosively expanding formation from within the upper zone downwardly toward the upper void, for explosively expanding upper and lower portions of the upper intermediate zone upwardly toward the upper void and downwardly toward the intermediate void, respectively, for explosively expanding upper and lower portions of the lower intermediate zone upwardly toward the intermediate void and downwardly toward the lower void, respectively, and for explosively expanding formation from within the lower zone upwardly toward the lower void, the amounts of formation explosively expanded from within the upper zone, the upper portion of the upper intermediate zone, the lower portion of the upper intermediate zone, the upper portion of the lower intermediate zone, the lower portion of the lower intermediate zone, and the lower zone being substantially equal to one another for forming a fragmented permeable mass of formation particles containing oil shale within an in situ oil shale retort.

26. The method according to claim 25 in which the centroids of the columns of explosive are spaced from their adjacent free faces by substantially the same vertical distance.

27. The method according to claim 25 in which the columns of explosive in the upper and lower blast holes are substantially the same length, and the columns of explosive in the upper intermediate and lower intermediate blast holes are substantially the same length and are twice as long as the columns of explosive in the upper and lower blast holes, and in which the columns of explosive in the upper intermediate and lower intermediate blast holes are located substantially in the middle of the upper intermediate and lower intermediate zones, respectively.

28. The method according to claim 25 in which the vertical height of the upper intermediate and lower intermediate zones is substantially the same and such vertical height is substantially twice the height of the upper and lower zones.

29. The method according to claim 28 including loading explosive in approximately the upper half of the upper blast holes and in approximately the lower half of the lower blast holes, and loading explosive in approximately the middle half of the upper and lower intermediate blast holes.

30. The method according to claim 29 including initiating detonation at the upper ends of the explosive columns in the upper blast holes, at the lower ends of the explosive columns in the lower blast holes, and at the middle of the explosive columns in the upper intermediate and lower intermediate blast holes.

31. The method according to claim 25 in which the direction of propagation of detonation of explosive in the upper and lower blast holes is toward the upper free face adjacent the upper void and toward the lower free face adjacent the lower void, respectively; in which the direction of propagation of detonation of explosive in the upper intermediate blast holes is toward both the lower free face adjacent the upper void and the upper free face adjacent the intermediate void; and in which the direction of propagation of explosive detonation in the lower intermediate blast holes is toward both the lower free face adjacent the intermediate void and the upper free face adjacent the lower void.

32. The method according to claim 31 including initiating detonation at the upper ends of the explosive columns in the upper blast holes, at the lower ends of the explosive columns in the lower blast holes, and at the middle of the explosive columns in the upper intermediate and lower intermediate blast holes.

33. In a method for forming an in situ oil shale retort in a subterranean formation containing oil shale, such an in situ oil shale retort containing a fragmented permeable mass of formation particles containing oil shale, wherein a retorting zone is established in an upper level of the fragmented mass and advanced downwardly through the fragmented mass, and liquid and gaseous products of retorting are withdrawn from a production level at a lower portion of the fragmented mass on the advancing side of the retorting zone, the improvement comprising:

excavating formation from within the retort site for forming a first void extending horizontally across the retort site, leaving a lower zone of unfragmented formation immediately below the first void;

excavating formation from within the retort site at a production level below the lower zone of unfragmented formation for forming a second void extending horizontally across the retort site at the production level, the horizontal cross-sectional area of the second void being substantially less than the horizontal cross-sectional area of the first void;

placing explosive in the lower zone of unfragmented formation; and detonating such explosive for explosively expanding formation from the lower zone toward both the first and second voids for forming a fragmented permeable mass of formation particles containing oil shale near a production level of an in situ oil shale retort.

34. The method according to claim 33 including:

drilling a plurality of vertical outer blast holes from the first void down into an outer portion of the lower zone of unfragmented formation to a bottom boundary of the fragmented mass being formed;

drilling a plurality of vertical inner blast holes in the lower zone of unfragmented formation between the first and second voids;

placing explosive in the inner and outer blast holes; and detonating explosive in the outer blast holes for explosively expanding formation from an outer portion of the lower zone upwardly toward the first void, and in the same round detonating explosive in the inner blast holes for explosively expanding formation from within the lower zone upwardly and downwardly toward the first and second voids, respectively.

35. The method according to claim 34 wherein the inner blast holes are drilled down from the first void toward the second void and extend more than half-way from the first void to the second void; and the inner blast holes are longer than at least a portion of the outer blast holes.

36. The method according to claim 35 including placing columns of explosive in the inner and outer blast holes; initiating detonation near the bottom of the columns of explosive in the outer blast holes, and initiating detonation of explosive in the inner blast holes between the ends of the columns of explosive therein.

37. The method according to claim 35 including placing columns of explosive in the inner and outer blast holes so that the upper ends of the columns of explosive therein are spaced approximately the same vertical distance from the first void.

38. The method according to claim 33 in which the volume of the second void relative to the amount of formation explosively expanded toward the second void is proportionately greater than the volume of the first void relative to the amount of formation explosively expanded toward the first void, for providing a larger void fraction of the fragmented mass near the elevation of the second void than the void fraction of the fragmented mass near the elevation of the first void.

39. The method according to claim 33 wherein the outer blast holes are horizontally offset from the inner blast holes on opposite sides of the retort being formed for forming a fragmented mass which, in vertical cross-section, has a generally T-shaped bottom.

40. The method according to claim 33 wherein the outer blast holes are offset horizontally from the inner blast holes substantially entirely around the retort being formed for forming a fragmented mass which, in vertical cross-section, has a generally T-shaped bottom, the lower portion of the T being offset horizontally inwardly from at least some of the side boundaries of an upper portion of the fragmented mass formed above the T-shaped bottom.

41. The metal according to claim 33 in which the second void is excavated to have a horizontal cross-sectional sectional area in the range of from about 30% to 70% of the horizontal cross-sectional area of the first void.

42. A method for forming an in situ oil shale retort in a subterranean formation containing oil shale, such an in situ oil shale retort containing a fragmented permeable mass of formation particles containing oil shale and having top, bottom and side boundaries, comprising the steps of:

excavating formation from within the retort site for forming a plurality of vertically spaced apart horizontal voids each having a horizontal cross-sectional area substantially the same as the horizontal cross-sectional area of the fragmented mass being formed, said horizontal voids including a lower void at a lower level of the fragmented mass being formed;

excavating at least one horizontally extending void at a production level below the level of the lower void, leaving a lower zone of unfragmented formation between the lower void and the elevation of such a production level void, such production level void having a horizontal cross-sectional area substantially less than the horizontal cross-sectional area of the lower void;

drilling a plurality of vertical blast holes below the lower void, a first group of such blast holes extending to the bottom boundary of the fragmented mass being formed in a region horizontally offset from such production level void, a second group of such blast holes being in the region above such production level void and extending more than half-way between the lower void and such production level void;

placing explosive in the blast holes; and detonating explosive in the first and second groups of the blast holes in a single round, so that explosive in the first group of the blast holes explosively expands formation from the lower zone upwardly toward the lower void, and so that explosive in the second group of the blast holes explosively expands formation from the lower zone upwardly toward the lower void and downwardly toward such a production level void for forming a fragmented permeable mass of formation particles containing oil shale in a lower portion of an in situ oil shale retort.

43. The method according to claim 42 including loading separate columns of explosive in the blast holes; and initiating detonation of explosive in the second group of blast holes between the ends of the columns of explosive therein so that detonation propagates upwardly toward the lower void and downwardly toward such a production level void.

44. The method according to claim 42 wherein the blast holes in the second group have a greater length than the blast holes in the first group.

45. The method according to claim 44 including placing columns of explosive in the first group of blast holes and in the second group of blast holes, initiating detonation of explosive near the bottom of explosive in the first group of blast holes, and initiating detonation of explosive in the second group of blast holes between the ends of the columns of explosive therein.

46. The method according to claim 44 including placing columns of explosive in the first group of blast holes and in the second group of blast holes, the upper ends of the columns of explosive in the first group and in the second group of blast holes being spaced approximately the same vertical distance from the lower void.

47. The method according to claim 42 in which the volume of the production level void relative to the amount of formation explosively expanded toward the production level void, is proportionately greater, than the volume of the lower void relative to the amount of formation explosively expanded toward the lower void, for providing a larger void fraction of the fragmented mass near the elevation of the production level than the void fraction of the fragmented mass near the elevation of the lower void.

48. The method according to claim 42 wherein the first group of blast holes is horizontally offset from the second group of blast holes on opposite sides of the retort being formed for forming a fragmented mass which, in vertical cross-section, has a generally T-shaped bottom.

49. A method for forming an in situ oil shale retort in a subterranean formation containing oil shale, such an in situ oil shale retort containing a fragmented permeable mass of formation particles containing oil shale, comprising the steps of:

excavating formation from within the retort site for forming a lower void extending horizontally across a lower level of the retort site;

excavating formation from a production level of the retort site for forming at least one production level void spaced vertically below the lower void, leaving a lower zone of unfragmented formation between the lower void and the elevation of the production level void, the lower zone having a first portion of approximately uniform thickness below a lower free face adjacent the lower void, the lower zone having a second portion above an upper free face adjacent such a production level void, the horizontal cross-sectional area of the second portion of the lower zone being substantially smaller than the horizontal cross-sectional area of the first portion of the lower zone; and in a single round explosively expanding the first portion of the lower zone upwardly toward the lower void; and explosively expanding the second portion of the lower zone downwardly toward such production level void for forming a fragmented permeable mass of formation particles containing oil shale near a production level of an in situ oil shale retort.

50. The method according to claim 49 in which the volume of the production level void relative to the amount of formation explosively expanded toward the production level void is proportionately greater, than the volume of the lower void relative to the amount of formation explosively expanded toward the lower void, so that the fragmented mass has a larger void fraction at about the elevation of the production level void than the void fraction at about the elevation of the lower void.

51. The method according to claim 50 including drilling an array of blast holes in the lower zone of unfragmented formation, a first group of such blast holes being offset horizontally from a second group of such blast holes, the first group of blast holes extending through the first portion of the lower zone for a depth substantially equal to the thickness of the first portion of the lower zone, the second group of blast holes extending through the entire depth of the first portion of the lower zone and into the second portion of the lower zone.

52. The method according to claim 51 including placing separate columns of explosive in the blast holes in the first and second groups, a larger amount of explosive being placed in the second group of blast holes than in the first group of blast holes.

53. The method according to claim 52 in which the tops of the columns of explosive in the first group of blast holes and in the second group of blast holes are located substantially the said vertical distance from the lower free face of the lower void.

54. The method according to claim 50 wherein the horizontal cross-sectional area of the second portion of the lower zone is about 30% to about 70% of the horizontal cross-sectional area of the first portion of the lower zone.

55. A method for forming an in situ oil shale retort in a retort site within a subterranean formation containing oil shale, comprising the steps of:

excavating formation from within the retort site for forming an upper void extending horizontally across the retort site and a lower void extending horizontally across the retort site below the upper void, leaving a zone of unfragmented formation within the retort site between the upper void and the lower void, the excavated volumes of the upper and lower voids being substantially the same;

placing explosive in the zone of unfragmented formation; and detonating such explosive for explosively expanding substantially the same amount of formation from said zone upwardly toward the upper void that is explosively expanded from said zone downwardly toward the lower void, with such explosive having substantially the same scaled depth of burial below the upper void and above the lower void.

56. A method for forming an in situ oil shale retort in a retort site within a subterranean formation containing oil shale, the in situ oil shale retort containing a fragmented permeable mass of formation particles containing oil shale, comprising the steps of:

excavating formation from within the retort site for forming a void having a horizontal cross-section similar to the horizontal cross-section of the fragmented mass being formed, leaving an upper zone of unfragmented formation having a lower free face of formation above the void, and leaving a lower zone of unfragmented formation having an upper free face of formation below the void;

placing explosive charges in the upper and lower zones of unfragmented formation; and detonating explosive charges in the upper and lower zones in a single round for explosively expanding substantially the same amount of formation downwardly from the upper zone toward the lower free face that is explosively expanded upwardly from the lower zone toward the upper free face, with the explosive in the upper zone having substantially the same scaled depth of burial from the lower free face as the explosive charges in the lower zone have from the upper free face, for forming a fragmented permeable mass of formation particles containing oil shale in an in situ oil shale retort.

57. A method for forming an in situ oil shale retort in a retort site in a subterranean formation containing oil shale, such an in situ oil shale retort containing a fragmented permeable mass of formation particles containing oil shale, comprising the steps of:

excavating formation from within the retort site for forming at least one void extending horizontally across the retort site, leaving an upper zone of unfragmented formation within the retort site immediately above the void, and leaving a lower zone of unfragmented formation within the retort site immediately below the void, the lower zone having substantially the same vertical height as the upper zone;

placing explosive in mutually spaced apart vertical upper blast holes in the upper zone of unfragmented formation, and placing explosive in mutually spaced apart vertical lower blast holes in the lower zone of unfragmented formation; and initiating detonation of explosive in each of the upper and lower blast holes in a single round, such detonation being initiated remote from the void, for explosively expanding substantially the same amount of formation from the upper zone downwardly toward the void that is explosively expanded from the lower zone upwardly toward the void for forming a fragmented permeable mass of formation particles containing oil shale in an in situ oil shale retort;

establishing a retorting zone in an upper portion of the fragmented mass;

introducing a retorting gas into the fragmented mass for sustaining the retorting zone and for advancing the retorting zone through the fragmented mass; and withdrawing liquid and gaseous products of retorting from a lower portion of the fragmented mass on the advancing side of the retorting zone.

* * * * *